US009678449B2

(12) United States Patent
Murakami et al.

(10) Patent No.: US 9,678,449 B2
(45) Date of Patent: Jun. 13, 2017

(54) ELECTROSTATIC CHARGE IMAGE DEVELOPING TONER, ELECTROSTATIC CHARGE IMAGE DEVELOPER, AND TONER CARTRIDGE

(71) Applicant: FUJI XEROX CO., LTD., Tokyo (JP)

(72) Inventors: Tsuyoshi Murakami, Kanagawa (JP); Atsushi Sugawara, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/996,825

(22) Filed: Jan. 15, 2016

(65) Prior Publication Data

US 2017/0060009 A1 Mar. 2, 2017

(30) Foreign Application Priority Data

Aug. 25, 2015 (JP) ..... 2015-165687

(51) Int. Cl.

| | |
|---|---|
| ***G03G 9/087*** | (2006.01) |
| ***G03G 9/08*** | (2006.01) |
| ***G03G 15/08*** | (2006.01) |

(52) U.S. Cl.

CPC ..... *G03G 9/0825* (2013.01); *G03G 9/0821* (2013.01); *G03G 9/08711* (2013.01); *G03G 15/0865* (2013.01)

(58) Field of Classification Search

CPC . G03G 9/0821; G03G 9/0825; G03G 9/08755

See application file for complete search history.

(56) References Cited

U.S. PATENT DOCUMENTS 7,056,638 B1 6/2006 Tomita et al.

FOREIGN PATENT DOCUMENTS

| | | |
|---|---|---|
| JP | 2004-145243 A | 5/2004 |
| JP | 2011-158758 A | 8/2011 |

*Primary Examiner* — Peter Vajda

(74) *Attorney, Agent, or Firm* — Oliff PLC

(57) ABSTRACT

An electrostatic charge image developing toner includes a toner particle which has a sea portion containing a binder resin and an island portion containing a release agent, wherein a melt viscosity at 100° C. of the toner is from 4,000 to 200,000 Pa·s, a flow activation energy of the toner is 18,000 to 80,000 $J \cdot mol^{-1}$, a maximum frequent value in distribution of eccentricity B of the island portion is from 0.75 to 0.98, a skewness in the distribution of the eccentricity B is from −1.10 to −0.50, and the eccentricity B is expressed by 2d/D, wherein D indicates an equivalent circle diameter (μm) of the toner in an observation of a cross-section of the toner, and d indicates a distance (μm) from a centroid of the toner to a centroid of the island portion containing the release agent in the observation of a cross-section of the toner.

9 Claims, 4 Drawing Sheets

ELECTROSTATIC CHARGE IMAGE DEVELOPING TONER, ELECTROSTATIC CHARGE IMAGE DEVELOPER, AND TONER CARTRIDGE

CROSS-REFERENCE TO RELATED APPLICATIONS

This application is based on and claims priority under 35 USC 119 from Japanese Patent Application No. 2015-165687 filed Aug. 25, 2015.

BACKGROUND

1. Technical Field

The present invention relates to an electrostatic charge image developing toner, an electrostatic charge image developer, and a toner cartridge.

2. Related Art

In recent years, an electrophotographic process has not only been used in a copying machine, but has also been widely used in a network printer in an office, a printer of a personal computer, a printer for print on demand, and the like according to the development of devices or improvement of a communication network in the information society, and realization of high image quality, highspeed, high reliability, small scale, light weight, and energy savings has been more strongly required in black and white and color printing.

In the electrophotographic process, a fixed image is generally formed through plural steps of electrically forming an electrostatic charge image on a photoreceptor (image holding member) using a photoconductive substance, with various units, developing the electrostatic charge image using a developer containing a toner, transferring a toner image on the photoreceptor to a recording medium such as paper through an intermediate transfer member or directly, and fixing the transferred image onto the recording medium.

SUMMARY

According to an aspect of the invention, there is provided an electrostatic charge image developing toner, including a toner particle which contains a binder resin and a release agent and has a sea-island structure including a sea portion containing the binder resin and an island portion containing the release agent, wherein a melt viscosity of the toner satisfies the following Expression (1), a flow activation energy based on the Andrade equation of the toner satisfies the following Expression (2), a maximum frequent value in distribution of the following eccentricity B of the island portion containing the release agent shown in the following Expression (3) is in a range of 0.75 to 0.98, and a skewness in the distribution of the eccentricity B is in a range of −1.10 to −0.50:

$$4{,}000\ \text{Pa·s} \leq \eta(100) \leq 200{,}000\ \text{Pa·s} \qquad \text{Expression (1)}$$

wherein η(100) represents a melt viscosity (measured by an elevated flow tester) at 100° C.;

$$18{,}000\ \text{J·mol}^{-1} \leq E \leq 80{,}000\ \text{J·mol}^{-1} \qquad \text{Expression (2)}$$

wherein E represents a flow activation energy based on the Andrade equation; and $$\text{eccentricity } B = 2\ d/D \qquad \text{Expression (3)}$$

wherein D indicates an equivalent circle diameter (μm) of the toner in an observation of a cross-section of the toner, and d indicates a distance (μm) from a centroid of the toner to a centroid of the island portion containing the release agent in the observation of a cross-section of the toner.

BRIEF DESCRIPTION OF THE DRAWINGS

Exemplary embodiments of the present invention will be described in detail based on the following figures, wherein.

DETAILED DESCRIPTION

Figure 1:
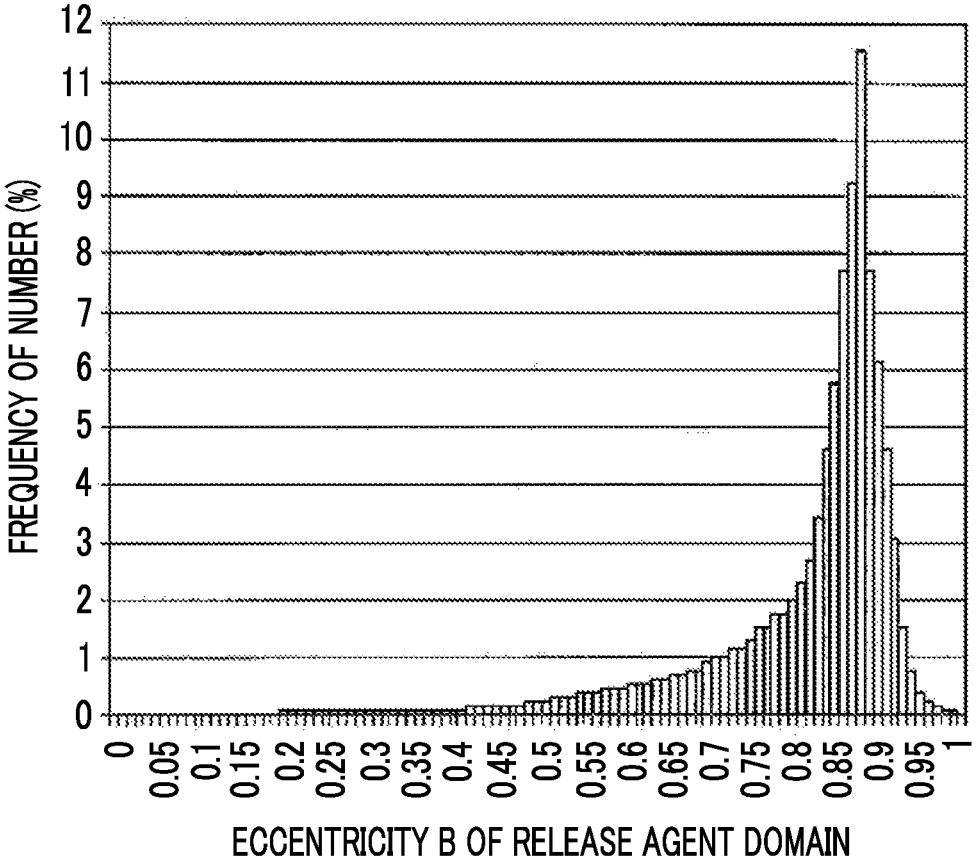
FIG. 1 is a view showing an example of distribution of eccentricity B of a release agent domain of a toner according to the exemplary embodiment.

Hereinafter, exemplary embodiments of an electrostatic charge image developing toner, an electrostatic charge image developer, a toner cartridge, a process cartridge, an image forming apparatus, and an image forming method will be described in detail.

Electrostatic Charge Image Developing Toner

An electrostatic charge image developing toner of the exemplary embodiment (hereinafter, the electrostatic charge image developing toner may be referred to as a "toner") is an electrostatic charge image developing toner containing a binder resin and a release agent and having a sea-island structure including a sea portion containing the binder resin and an island portion containing the release agent, in which relationship expressions regarding a melt viscosity shown in the following Expression (1) and the following Expression (2) are satisfied, a maximum frequent value in distribution of eccentricity B of the island portion containing the release agent shown in the following Expression (3) is in a range of 0.75 to 0.98, and a skewness in distribution of the eccentricity B is in a range of −1.10 to −0.50.

$$4{,}000\ \text{Pa·s} \leq \eta(100) \leq 200{,}000\ \text{Pa·s} \qquad \text{Expression (1):}$$

In Expression (1), η(100) represents an elevated flow tester melt viscosity at 100° C.

$$18{,}000\ \text{J·mol}^{-1} \leq E + 80{,}000\ \text{J·mol}^{-1} \qquad \text{Expression (2):}$$

In Expression (2), E represents flow activation energy based on Andrade equation.

$$\text{eccentricity } B = 2\ d/D \qquad \text{Expression (3):}$$

In Expression (3), D indicates an equivalent circle diameter (μm) of the toner in an observation of a cross-section of the toner, and d indicates a distance (μm) from a centroid of the toner to a centroid of the island portion containing the release agent in the observation of a cross-section of the toner.

When forming a toner image on a sheet having great unevenness using the toner of the exemplary embodiment, white spots are decreased. The reason thereof is not clear but the following are expected.

In recent years, requirements in the light printing market such as electrophotographic on-demand printing have been increased and the printing needs to be able to cope with usage of various sheets such as a rough sheet having large projections and recesses and realize higher image quality and printing speed than the technologies in the related art. Particularly, minute image deletion (hereinafter, may be referred to as "minute white spots") easily occur, due to large projections and recesses in the printing on a rough sheet and difficulties in transmission of heat and pressure when fixing a toner which enters recesses. It is expected that the minute white spots are formed because heat and pressure are hardly transmitted to the toner which enters recesses of a sheet, bleeding of a release agent to a surface of a toner is insufficient due to non-smooth melting of a toner, which causes difficulties in separation between a fixing member and a toner, and a toner which is not separated may be leaked from an image. Even when a melt viscosity of a toner is simply decreased or an amount of a release agent is increased, in order to improve the minute white spots, hot offsetting due to excessively melted toner in projections of a sheet or uneven glossiness due to excessive bleeding of a release agent may not be prevented. As described above, it is difficult to provide a high-quality image without minute white spots on a sheet having large projections and recesses such as a rough sheet.

In the embodiment, meltability of a toner is maintained, a large amount of a release agent is present in the vicinity of a surface of a toner, and a suitable amount of a release agent is also present in the toner, by using a toner having a sea-island structure including a sea portion containing a binder resin and an island portion containing a release agent, in which an elevated flow tester melt viscosity $\eta(\mathbf{100})$ at 100° C. of the toner is in a range of 4,000 Pa·s to 200,000 Pa·s, flow activation energy E based on Andrade equation is in a range of 18,000 $J \cdot mol^{-1}$ to 80,000 $J \cdot mol^{-1}$, a maximum frequent value in distribution of eccentricity B of the island portion containing the release agent is in a range of 0.75 to 0.98, and a skewness in distribution of the eccentricity B is in a range of −1.10 to −0.50.

When such a toner is used, the melting of the toner is also smoothly performed even in the recesses of a sheet, the bleeding of the release agent is performed in the vicinity of the surface, and accordingly, sufficient releasing properties are exhibited and minute white spots are improved, at the time of high-speed printing using a rough sheet. It is expected that excessive toner melting or bleeding of the release agent in the projections of a sheet is prevented and uneven glossiness is prevented.

The toner of the exemplary embodiment is advantageous in a point that minute image deletion is decreased when forming a toner image on a sheet having large projections and recesses such as a rough sheet, and particularly, the toner also exhibits an effect of reducing minute image deletion when forming a toner image on a sheet having a Bekk smoothness equal to or less than 50 seconds.

In the exemplary embodiment, the Bekk smoothness is a value measured based on a method of JIS P 8119 (1998).

Herein, the eccentricity B of the island portion containing the release agent (hereinafter, also referred to as a "release agent domain") is an index showing how far a centroid of the release agent domain is separated from a centroid of the toner. The eccentricity B indicates that as a value is increased, the release agent domain is present near the surface of the toner, and as a value is decreased, the release agent domain is present near the center of the toner. The maximum frequent value in distribution of eccentricity B indicates a portion where the largest amount of the release agent domains is present in a radial direction of the toner. Meanwhile, the skewness in the distribution of the eccentricity B indicates right-left symmetry of the distribution. Specifically, the skewness in the distribution of the eccentricity B indicates a trailing degree in distribution from the maximum frequent value. That is, the skewness in the distribution of the eccentricity B indicates in which degree of distribution the release agent domain is present from the portion where the largest amount of the release agent domains is present, in a radial direction of the toner.

That is, a state where the maximum frequent value in the distribution of the eccentricity B is in a range of 0.75 to 0.98 indicates that a large amount of release agent domains is present in a surface portion of the toner. A state where the skewness in the distribution of the eccentricity B of the release agent domain is in a range of −1.10 to −0.50 indicates that the release agent domains are distributed from a toner surface portion towards the inner portion with a gradient (see FIG. 1).

As described above, the toner in which the maximum frequent value and the skewness in the distribution of the eccentricity B of the release agent domain satisfy the ranges described above, is a toner in which a large amount of the release agent domains is present in a surface portion and distributed from the inner portion of the toner to the surface portion with a gradient. When low pressure is applied to the toner having a gradient in the distribution of the release agent domain, only the release agent in the toner surface portion bleeds out and when high pressure is applied thereto, the release agent in the inner portion of the toner also bleeds out. That is, in the toner having a concentration gradient of the release agent domain, the amount of bleeding of the release agents is controlled according to pressure.

The toner according to the exemplary embodiment has a sea-island structure including a sea portion containing a binder resin and an island portion including a release agent. That is, the toner has a sea-island structure in which a release agent exists in a continuous phase of a binder resin so as to have an island shape. The release agent domain may not exist in a center portion (centroid) of the toner in observation of the cross-section of the toner, in order to prevent separation failure and prevent uneven glossiness.

In the toner having a sea-island structure, the maximum frequent value in distribution of the eccentricity B of the release agent domain (island portion containing the release agent) is from 0.75 to 0.98, preferably from 0.80 to 0.95, and more preferably from 0.85 to 0.90, in order to prevent separation failure and prevent uneven glossiness. Particularly, the maximum frequent value in distribution of the eccentricity B of the release agent domain is preferably equal to or smaller than 0.98, from a viewpoint of heat storability of the toner.

The skewness in the distribution of the eccentricity B of the release agent domain (island portion containing the release agent) is from −1.10 to −0.50, preferably from −1.00 to −0.60, and more preferably from −0.95 to −0.65, in order to prevent uneven glossiness.

A kurtosis in the distribution of the eccentricity B of the release agent domain (island portion containing the release agent) is preferably from −0.20 to +1.50, more preferably from −0.15 to +1.40, and even more preferably from −0.10 to +1.30, in order to prevent separation failure and prevent uneven glossiness.

The kurtosis indicates an index showing a point of an apex (that is, maximum frequent value in distribution) in the distribution of the eccentricity B. A state where the kurtosis is in the range described above indicates a state where an apex (maximum frequent value) in the distribution of the eccentricity B is not excessively sharp-pointed, but the distribution has a point but also a suitable curve. Accordingly, a change in a bleeding amount of the release agent from the toner according to pressure becomes smooth, a bleeding amount of the release agent from the toner in projections and recesses of a recording medium is easily maintained, and separation failure and uneven glossiness are further prevented.

A confirming method of the sea and island structure of the toner will be described.

The sea and island structure of the toner is confirmed, for example, by a method of observing a cross-section of the toner (toner particle) using a transmission electron microscope, or a method of dyeing a cross-section of the toner particle with ruthenium tetroxide and observing the dyed cross-section using a scanning electron microscope. The method of observation using a scanning electron microscope is preferable in that the release agent domain in the cross-section of the toner may be observed more clearly. As the scanning electron microscope, a model which has been known well to those skilled in the related art may be used. For example, SU8020 manufactured by Hitachi High-Technologies Corporation, JSM-7500F manufactured by JEOL Ltd., and the like are included.

Specifically, an observing method is performed as follows. First, a toner (toner particle) to be measured is embedded in an epoxy resin, and then the epoxy resin is cured. This cured substance is cut into a thin section with a microtome including a diamond blade to thereby obtain an observation sample in which a cross-section of the toner is exposed. Dyeing with ruthenium tetroxide is performed on the thin observation sample and the cross-section of the toner is observed by using a scanning electron microscope. Using this observing method, a sea and island structure in which a release agent having a brightness difference (contrast) caused by a dyeing degree with respect to a continuous phase of a binder resin exists so as to have an island shape in the cross-section of the toner is observed.

Next, a measuring method of the eccentricity B of the release agent domain will be described.

The eccentricity B of the release agent domain is measured as follows. First, an image is recorded at magnification which allows a cross-section of one toner (toner particle) to come in sight, by using the confirming method of the sea and island structure. Image analysis for the recorded image is performed under a condition of 0.010000 μm/pixel by using image analysis software (WINROOF manufactured by MITANI Corporation). A shape of the cross-section of the toner is extracted by this image analysis by using a brightness difference (contrast) between the epoxy resin used in embedding and the binder resin of the toner. A projected area is obtained based on the extracted shape of the cross-section of the toner. An equivalent circle diameter is obtained from the projected area. The equivalent circle diameter is calculated by an expression of $2\times$ (projected area/$\pi$)$^{1/2}$. The obtained equivalent circle diameter is set as an equivalent circle diameter D of the toner in observation of the cross-section of the toner.

A centroid position is obtained based on the extracted shape of the cross-section of the toner. Subsequently, a shape of the release agent domain is extracted by using a brightness difference (contrast) between the binder resin and the release agent, and a centroid position of the release agent domain is obtained. Each of the centroid positions is obtained as follows. x coordinates of the centroids are values obtained by dividing summation of $x_i$ coordinate values by n, and y coordinates of the centroids are values obtained by dividing summation of $y_i$ coordinate values by n, when the number of pixels in an area of the extracted toner or the extracted release agent domain is set as n, xy coordinates of each pixel are set as $x_i$ and $y_i$ (i=1, 2, . . . , n). A distance between the centroid position of the cross-section of the toner and the centroid position of the release agent domain is obtained. The obtained distance is set as a distance d from the centroid of the toner to the centroid of the island portion containing the release agent in observation of the cross-section of the toner.

At last, the eccentricity B of the release agent domain is obtained based on each of the equivalent circle diameter D and the distance d by using Expression (1) (eccentricity B=2 d/D). Similarly, the above-described operation is performed on each of plural release agent domains in the cross-section of one toner (toner particle) and thereby the eccentricity B of the release agent domain is obtained.

Next, a calculating method of the maximum frequent value in distribution of the eccentricity B of the release agent domain will be described.

First, the eccentricity B of the release agent domain for 200 toners (toner particles) is measured as described above. Data of the obtained eccentricity B of each of the release agent domains is subjected to statistical analysis processing in a data sections from 0 in increment of 0.01, and thereby the distribution of the eccentricity B is obtained. The maximum frequent value in the obtained distribution, that is, a value of a data section which appears most in the distribution of the eccentricity B of the release agent domain is obtained. The value of this data section is set as the maximum frequent value in the distribution of the eccentricity B of the release agent domain.

Next, a calculating method of the skewness in the distribution of the eccentricity B of the release agent domain will be described.

First, the distribution of the eccentricity B of the release agent domain is obtained as described above. The skewness in the obtained distribution of the eccentricity B is obtained based on the following expression. In the following expression, the skewness is set as Sk, the number of pieces of data of the eccentricity B of the release agent domain is set as n, values of data of the eccentricity B of the respective release agent domains are set as $x_1$(i=1, 2, . . . , n), an average value of all pieces of data of the eccentricity B of the release agent domain is set as x (x with a bar above), and a standard deviation of all pieces of data of the eccentricity B of the release agent domain is set as s.

$$Sk = \frac{n}{(n-1)(n-2)} \sum_{i=1}^{n} \left( \frac{x_i - \bar{x}}{s} \right)^3$$

Next, a calculating method of the kurtosis in the distribution of the eccentricity B of the release agent domain will be described.

First, the distribution of the eccentricity B of the release agent domain is obtained as described above. The kurtosis in the obtained distribution of the eccentricity B is obtained based on the following expression. In the following expression, the kurtosis is set as Ku, the number of pieces of data of the eccentricity B of the release agent domain is set as n, values of data of the eccentricity B of the respective release agent domains are set as $x_1$(i=1, 2, . . . , n), an average value of all pieces of data of the eccentricity B of the release agent domain is set as x (x with a bar above), and a standard deviation of all pieces of data of the eccentricity B of the release agent domain is set as s.

$$Ku = \frac{n(n+1)}{(n-1)(n-2)(n-3)}\sum_{i=1}^{n}\left(\frac{x_i-\bar{x}}{s}\right)^4 - \frac{3(n-1)^2}{(n-2)(n-3)}$$

Regarding a method for satisfying distribution characteristics of the eccentricity B of the release agent domain in a toner according to the exemplary embodiment, it will be described in a method of preparing the toner.

In the exemplary embodiment, the elevated flow tester melt viscosity η(100) is set to be in a range of 4,000 Pa·s to 200,000 Pa·s. When η(100) is smaller than 4,000 Pa·s, the melting at the time of fixation is excessively performed and hot offsetting may occur. On the other hand, when η(100) exceeds 200,000 Pa·s, melting at the time of fixation is insufficiently performed and minute white spots maybe formed.

The elevated flow tester melt viscosity η(100) is preferably from 6,000 Pa·s to 180,000 Pa·s, more preferably from 8000 Pa·s to 160,000 Pa·s, and even more preferably from 10,000 Pa·s to 140,000 Pa·s.

In the exemplary embodiment, a reason of focusing the elevated flow tester melt viscosity at 100° C. is because a viscosity of the binder resin is decreased due to the heating of the toner and accordingly, a temperature at which the release agent contained in the toner starts to be bled to the surface of the toner is approximately 100° C. By setting the elevated flow tester melt viscosity of the toner at a temperature at which the release agent starts to be bled to the surface of the toner to be in the predetermined range, an ease of bleeding of the release agent to the surface of the toner is adjusted.

Conditions for the measurement by an elevated flow tester are as follows.

In the measurement of the melt viscosity of the toner, 1.2 g of a sample is set to have a cylindrical shape by a sampler using an elevated flow tester (CFT-500 manufactured by Shimadzu Corporation) and the measurement is performed in the following conditions.

The heating at a constant temperature is performed in conditions with a diameter of a die (nozzle) of 0.5 mm and a thickness of 1.0 mm, a pressing load of 10 kgf/cm$^2$, a sectional area of a plunger of 1.0 cm$^2$, an initial setting temperature of 50° C., a pre-heating time of 300 sec, and a rate of temperature increase of 2° C./min.

A flowing amount at each temperature is measured at every 2° C. and a viscosity (Pa·s) at 100° C. is obtained.

In the embodiment, a method of adjusting a viscosity of a binder resin used is preferably used, in order to control the elevated flow tester melt viscosity of the toner. For example, the elevated flow tester melt viscosity of the toner maybe controlled to be in the range of the exemplary embodiment by preparing plural resins having different glass transition temperatures and changing a combination ratio of the resins.

In the exemplary embodiment, the flow activation energy E based on Andrade equation is in a range of 18,000 J·mol$^{-1}$ to 80,000 J·mol$^{-1}$. When the flow activation energy E is smaller than 18,000 J·mol$^{-1}$, the bleeding of the release agent is insufficiently performed in the recesses of the sheet and minute white spots may be formed. When the flow activation energy E exceeds 80,000 J·mol$^{-1}$, the bleeding of the release agent is excessively performed in the projections of a sheet, and therefore, uneven glossiness may be formed.

The flow activation energy E is preferably in a range of 19,000 J·mol$^{-1}$ to 70,000 J·mol$^{-1}$, more preferably in a range of 20,000 J·mol$^{-1}$ to 60,000 J·mol$^{-1}$, and even more preferably in a range of 21,000 J·mol$^{-1}$ to 50,000 J·mol$^{-1}$.

The flow activation energy E is calculated based on the following Andrade Equation (A). An Equation (A') is an equation obtained by logarithmic transformation of Equation (A).

$$\eta = A \cdot e^{\frac{E}{RT}} \tag{A}$$

$$In\eta = \ln A + \frac{E}{RT} \tag{A'}$$

In Equation (A) and Equation (A'), A represents a proportionality factor, E represents a flow activation energy, R represents a gas constant, T represents an absolute temperature, and η represents a viscosity of the toner at the absolute temperature T.

In the measurement of the elevated flow tester melt viscosity η(100), a logarithm Inη of the viscosity η obtained at the temperature T is plotted as a Y axis and a value of 1/T is plotted as an X axis, and the flow activation energy E is determined from inclination of the plotting.

The release agent domains exist in the surface portion of the toner by setting the maximum frequent value and the skewness in the distribution of the eccentricity B of the toner of the exemplary embodiment to have specific values, and the toner of the exemplary embodiment satisfies relationships of Expression (1) and Expression (2), and accordingly, the bleeding of the release agent existing in the surface portion of the toner as a domain is easily performed from the surface of the toner when fixing the toner.

Hereinafter, the toner according to the exemplary embodiment will be described in detail.

The toner according to the exemplary embodiment contains toner particles, and if necessary, an external additive.

Toner Particle

The toner particle, for example, contains a binder resin and a release agent, and if necessary, a colorant and other additives.

Binder Resin

Examples of the binder resins include a homopolymer composed of monomers such as styrenes (for example, styrene, p-chlorostyrene, α-methyl styrene, or the like), (meth)acrylic esters (for example, methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, 2-ethylhexyl methacrylate, or the like), ethylenic unsaturated nitriles (for example, acrylonitrile, methacrylonitrile, or the like), vinyl ethers (for example, vinyl methyl ether, vinyl isobutyl ether, or the like), vinyl ketones (for example, vinyl methyl ketone, vinyl ethyl ketone, vinyl isopropenyl ketone, or the like), olefins (for example, ethylene, propylene, butadiene, or the like), or a vinyl resin formed of a copolymer obtained by combining two or more kinds of these monomers.

Examples of the binder resin include a non-vinyl resin such as an epoxy resin, a polyester resin, a polyurethane resin, a polyamide resin, a cellulose resin, a polyether resin, and a modified rosin, a mixture of these and a vinyl resin as described above, or a graft polymer obtained by polymerizing a vinyl monomer in the presence thereof.

These binder resins may be used singly or in combination with two or more kinds thereof.

A glass transition temperature of the binder resin is preferably from 50° C. to 80° C. and more preferably from 50° C. to 65° C.

The glass transition temperature is determined by a DSC curve obtained by differential scanning calorimetry (DSC), and more specifically, is determined by "extrapolation glass transition starting temperature" disclosed in a method of determining the glass transition temperature of JIS K-7121-1987 "Testing Methods for Transition Temperature of Plastics".

In the exemplary embodiment, a glass transition temperature of the binder resin when using two or more kinds of binder resins in combination is shown as an average value of glass transition temperatures of each resin.

A polyester resin is suitable as the binder resin. As the polyester resin, a well-known polyester resin is used, for example.

As the polyester resin, a well-known polyester resin is used, for example.

Examples of the polyester resin include condensation polymers of polyvalent carboxylic acids and polyols. A commercially available product or a synthesized product may be used as the polyester resin.

Examples of the polyvalent carboxylic acid include aliphatic dicarboxylic acids (e.g., oxalic acid, malonic acid, maleic acid, fumaric acid, citraconic acid, itaconic acid, glutaconic acid, succinic acid, alkenyl succinic acid, adipic acid, and sebacic acid), alicyclic dicarboxylic acids (e.g., cyclohexanedicarboxylic acid), aromatic dicarboxylic acids (e.g., terephthalic acid, isophthalic acid, phthalic acid, and naphthalenedicarboxylic acid), anhydrides thereof, or lower alkyl esters (having, for example, from 1 to 5 carbon atoms) thereof. Among these, for example, aromatic dicarboxylic acids are preferably used as the polyvalent carboxylic acid.

As the polyvalent carboxylic acid, a tri- or higher-valent carboxylic acid employing a crosslinked structure or a branched structure may be used in combination together with a dicarboxylic acid. Examples of the tri- or higher-valent carboxylic acid include trimellitic acid, pyromellitic acid, anhydrides thereof, or lower alkyl esters (having, for example, from 1 to 5 carbon atoms) thereof.

The polyvalent carboxylic acids may be used alone or in combination of two or more kinds thereof.

Examples of the polyol include aliphatic diols (e.g., ethylene glycol, diethylene glycol, triethylene glycol, propylene glycol, butanediol, hexanediol, and neopentyl glycol), alicyclic diols (e.g., cyclohexanediol, cyclohexanedimethanol, and hydrogenated bisphenol A), and aromatic diols (e.g., ethylene oxide adduct of bisphenol A and propylene oxide adduct of bisphenol A). Among these, for example, aromatic dials and alicyclic dials are preferably used, and aromatic diols are more preferably used as the polyol.

As the polyol, a tri- or higher-valent polyol employing a crosslinked structure or a branched structure may be used in combination together with a diol. Examples of the tri- or higher-valent polyol include glycerin, trimethylolpropane, and pentaerythritol.

The polyols may be used alone or in combination of two or more kinds thereof.

A weight-average molecular weight (Mw) of the polyester resin is preferably from 5,000 to 1,000,000, and more preferably from 7,000 to 500,000.

The number-average molecular weight (Mn) of the polyester resin is preferably from 2,000 to 100,000.

The molecular weight distribution Mw/Mn of the polyester resin is preferably from 1.5 to 100, and more preferably from 2 to 60.

The weight-average molecular weight and the number-average molecular weight are measured by gel permeation chromatography (GPC). The molecular weight measurement by GPC is performed with a THF solvent using HLC-8120 GPC, which is GPC manufactured by Tosoh Corporation as a measurement device by using TSKGEL Super HM-M (15 cm), which is a column manufactured by Tosoh Corporation. The weight-average molecular weight and the number-average molecular weight are calculated using a calibration curve of molecular weight created with a monodisperse polystyrene standard sample from results of this measurement.

The polyester resin is obtained with a well-known preparing method. Specific examples thereof include a method of conducting a reaction at a polymerization temperature set to 180° C. to 230° C., if necessary, under reduced pressure in the reaction system, while removing water or an alcohol generated during condensation.

When monomers of the raw materials are not dissolved or compatibilized under a reaction temperature, a high-boiling-point solvent maybe added as a solubilizing agent to dissolve the monomers. In this case, a polycondensation reaction is conducted while distilling away the solubilizing agent. When a monomer having poor compatibility is present in a copolymerization reaction, the monomer having poor compatibility and an acid or an alcohol to be polycondensed with the monomer may be previously condensed and then polycondensed with the major component.

The content of the binder resin is preferably from 40% by weight to 95% by weight, more preferably from 50% by weight to 90% by weight, and even more preferably from 60% by weight to 85% by weight, with respect to the entire toner particles.

Colorant

Examples of the colorant include various pigments such as carbon black, chrome yellow, Hansa yellow, benzidine yellow, threne yellow, quinoline yellow, pigment yellow, permanent orange GTR, pyrazolone orange, vulcan orange, watchung red, permanent red, brilliant carmine 3B, brilliant carmine 6B, DuPont oil red, pyrazolone red, lithol red, Rhodamine B Lake, Lake Red C, pigment red, rose bengal, aniline blue, ultramarine blue, calco oil blue, methylene blue chloride, phthalocyanine blue, pigment blue, phthalocyanine green, and malachite green oxalate, and various dyes such as acridine dyes, xanthene dyes, azo dyes, benzoquinone dyes, azine dyes, anthraquinone dyes, thioindigo dyes, dioxadine dyes, thiazine dyes, azomethine dyes, indigo dyes, phthalocyanine dyes, aniline black dyes, polymethine dyes, triphenylmethane dyes, diphenylmethane dyes, and thiazole dyes.

The colorants may be used alone or in combination of two or more kinds thereof.

If necessary, the colorant may be surface-treated or used in combination with a dispersing agent. Plural kinds of colorants may be used in combination.

The content of the colorant is, for example, preferably from 1% by weight to 30% by weight, and more preferably from 3% by weight to 15% by weight with respect to the entirety of the toner particles.

Release Agent

Examples of the release agent include hydrocarbon waxes; natural waxes such as carnauba wax, rice wax, and candelilla wax; synthetic or mineral/petroleumwaxes such as montan wax; and ester waxes such as fatty acid esters and montanic acid esters. The release agent is not limited thereto.

The melting temperature of the release agent is preferably from 50° C. to 110° C., and more preferably from 60° C. to 100° C.

Further, the melting temperature is determined from a DSC curve obtained by differential scanning calorimetry (DSC), using the "melting peak temperature" described in the method of determining a melting temperature in the "Testing Methods for Transition Temperatures of Plastics" in JIS K-7121-1987.

The content of the release agent is, for example, preferably from 1% by weight to 20% by weight and more preferably from 5% by weight to 15% by weight, with respect to the entirety of the toner particles.

Other Additives

Examples of other additives include known additives such as a magnetic material, a charge-controlling agent, and an inorganic powder. The toner particles contain these additives as internal additives.

Characteristics of Toner Particle

The toner particle may be toner particle having a single-layer structure, or toner particles having a so-called core/shell structure composed of a core (core particle) and a coating layer (shell layer) coated on the core.

Here, toner particle having a core/shell structure is preferably composed of, for example, a core containing a binder resin, styrene acrylic resin particles, and if necessary, other additives such as a colorant and a coating layer containing a binder resin and a release agent.

The volume average particle size (D50v) of the toner particles is preferably from 2 μm to 10 μm, and more preferably from 4 μm to 8 μm.

Various average particle sizes and various particle size distribution indices of the toner particles are measured using a COULTER MULTISIZSER II (manufactured by Beckman Coulter, Inc.) and ISOTON-II (manufactured by Beckman Coulter, Inc.) as an electrolyte.

In the measurement, from 0.5 mg to 50 mg of a measurement sample is added to 2 ml of a 5% aqueous solution of surfactant (preferably sodium alkylbenzene sulfonate) as a dispersing agent. The obtained material is added to 100 ml to 150 ml of the electrolyte.

The electrolyte in which the sample is suspended is subjected to a dispersion treatment using an ultrasonic disperser for 1 minute, and a particle size distribution of particles having a particle size of 2 μm to 60 μm is measured by a COULTER MULTISIZER II using an aperture having an aperture size of 100 μm. 50,000 particles are sampled.

Cumulative distributions by volume and by number are drawn from the side of the smallest size with respect to particle size ranges (channels) separated based on the measured particle size distribution. The particle size when the cumulative percentage becomes 16% is defined as that corresponding to a volume average particle size D16v and a number-average particle size D16p, while the particle size when the cumulative percentage becomes 50% is defined as that corresponding to a volume average particle size D50v and a number-average particle size D50p. Furthermore, the particle size when the cumulative percentage becomes 84% is defined as that corresponding to a volume average particle size D84v and a number-average particle size D84p.

Using these, a volume average particle size distribution index (GSDv) is calculated as $(D84v/D16v)^{1/2}$, while a number-average particle size distribution index (GSDp) is calculated as $(D84p/D16p)^{1/2}$.

The shape factor SF1 of the toner particles is preferably from 110 to 150, and more preferably from 120 to 140.

The shape factor SF1 is obtained through the following expression.

Expression: $SF1=(ML^2/A)\times(\pi/4)\times 100$

In the foregoing expression, ML represents an absolute maximum length of a toner, and A represents a projected area of a toner.

Specifically, the shape factor SF1 is numerically converted mainly by analyzing a microscopic image or a scanning electron microscopic (SEM) image by using of an image analyzer, and is calculated as follows. That is, an optical microscopic image of particles scattered on a surface of a glass slide is input to an image analyzer LUZEX through a video camera to obtain maximum lengths and projected areas of 100 particles, values of SF1 are calculated through the foregoing expression, and an average value thereof is obtained.

External Additive

Examples of the external additive include inorganic particles. Examples of the inorganic particles include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)_n$, $Al_2C_3.2SiO_2$, $CaCO_3$, $MgCO_3$, $BaSO_4$, and $MgSO_4$.

Surfaces of the inorganic particles as an external additive are preferably subjected to a hydrophobizing treatment. The hydrophobizing treatment is performed by, for example, dipping the inorganic particles in a hydrophobizing agent. The hydrophobizing agent is not particularly limited and examples thereof include a silane coupling agent, silicone oil, a titanate coupling agent, and an aluminum coupling agent. These may be used alone or in combination of two or more kinds thereof.

Generally, the amount of the hydrophobizing agent is, for example, from 1 part by weight to 10 parts by weight with respect to 100 parts by weight of the inorganic particles.

Examples of the external additive also include resin particles (resin particles such as polystyrene, PMMA, and melamine resin particles) and a cleaning aid (e.g., metal salt of higher fatty acid represented by zinc stearate, and fluorine-based polymer particles).

The amount of the external additive externally added is, for example, preferably from 0.01% by weight to 5% by weight, and more preferably from 0.01% by weight to 2.0% by weight with respect to the toner particles.

Toner Preparing Method

Next, a method of preparing a toner according to this exemplary embodiment will be described.

The toner according to this exemplary embodiment is obtained by externally adding an external additive to toner particles after preparing of the toner particles.

The toner particles may be prepared using any of a dry preparing method (e.g., kneading and pulverizing method) and a wet preparing method (e.g., aggregation and coalescence method, suspension and polymerization method, and dissolution and suspension method). The toner particle preparing method is not particularly limited to these preparing methods, and a known preparing method is employed.

Among these, the toner particles are preferably obtained by an aggregation and coalescence method.

For preparing the toner (toner particle) which satisfies the above-described distribution characteristics of the eccentricity B of the release agent domain as described above, the toner particle may preferably be prepared by an aggregation and coalescence method described below.

Specifically, the toner particle is preferably prepared by processes as follows: a process of preparing each dispersion (dispersion preparation process); a process (first aggregated particle forming process); a process (second aggregated particle forming process); and a process (coalescence process). In the first aggregated particle forming process, particles are aggregated in a dispersion obtained by mixing a first resin particle dispersion and a colorant particle dispersion, and thereby first aggregated particles are formed. The first resin particle dispersion is obtained by dispersing first resin particles corresponding to the binder resin, and the colorant particle dispersion is obtained by dispersing particles of the colorant (also referred to as "colorant particles" below). In the second aggregated particle forming process, a dispersion mixture in which second resin particles corresponding to the binder resin and particles of the release agent (also referred to as "release agent particles" below) are dispersed is prepared. After a first aggregated particle dispersion in which the first aggregated particles are dispersed is prepared, the dispersion mixture is sequentially added to the first aggregated particle dispersion while the concentration of the release agent particles in the dispersion mixture slowly increases. Thus, the second resin particles and the release agent particles are aggregated on a surface of the first aggregated particles, and thereby second aggregated particles are formed. In the coalescence process, a second aggregated particle dispersion in which the second aggregated particles are dispersed is heated to coalesce the second aggregated particles, and thereby toner particles are formed.

The method of preparing the toner particle is not limited to the above descriptions. For example, particles are aggregated in a dispersion mixture obtained by mixing the resin particle dispersion and the colorant particle dispersion. Then, a release agent particle dispersion is added to the dispersion mixture in the process of aggregation while increasing an addition speed slowly or while increasing the concentration of the release agent particles. Thus, aggregation of particles proceeds more, and thereby aggregated particles are formed. The toner particles may be formed by coalescing the aggregated particles.

The processes will be described below in detail.

Preparation Process of Dispersion

First, respective dispersions are prepared by using an aggregation and coalescence method. Specifically, a first resin particle dispersion in which first resin particles corresponding to the binder resin are dispersed, a colorant particle dispersion in which colorant particles are dispersed, a second resin particle dispersion in which second resin particles corresponding to the binder resin are dispersed, and a release agent particle dispersion in which release agent particles are dispersed are prepared.

In the dispersion preparation process, descriptions will be made, referring the first resin particles and the second resin particles to as "resin particles" collectively.

When two or more kinds of binder resins are used in combination, plural kinds of binder resins may be mixed to prepare the resin particle dispersion. In this case, one resin particle includes plural kinds of binder resins. Alternatively, the dispersions may be prepared corresponding to each of plural kinds of binder resins, and then, the dispersions are mixed to prepare the resin particle dispersion. In this case, one resin particle includes one kind of binder resin.

The resin particle dispersion is prepared by, for example, dispersing resin particles in a dispersion medium using a surfactant.

Examples of the dispersion medium used for the resin particle dispersion include aqueous mediums.

Examples of the aqueous mediums include water such as distilled water and ion exchange water, and alcohols. These may be used singly or in combination of two or more kinds thereof.

Examples of the surfactant include anionic surfactants such as a sulfuric ester salt, a sulfonate, a phosphate ester, and a soap; cationic surfactants such as an amine salt and a quaternary ammonium salt; and nonionic surfactants such as polyethylene glycol, an ethylene oxide adduct of alkyl phenol, and polyol. Among these, anionic surfactants and cationic surfactants are particularly preferably used. Nonionic surfactants maybe used in combination with anionic surfactants or cationic surfactants.

The surfactants may be used singly or in combination of two or more kinds thereof.

Regarding the resin particle dispersion, as a method of dispersing the resin particles in the dispersion medium, a common dispersing method using, for example, a rotary shearing-type homogenizer, or a ball mill, a sand mill, or a DYNO mill having media is exemplified. Depending on the kind of the resin particles, resin particles may be dispersed in the resin particle dispersion according to, for example, a phase inversion emulsification method.

The phase inversion emulsification method includes: dissolving a resin to be dispersed in a hydrophobic organic solvent in which the resin is soluble; conducting neutralization by adding abase to an organic continuous phase (O phase); and converting the resin (so-called phase inversion) from W/O to O/W by putting an aqueous medium (W phase) to form a discontinuous phase, thereby dispersing the resin as particles in the aqueous medium.

A volume average particle diameter of the resin particles dispersed in the resin particle dispersion is, for example, preferably from 0.01 μm to 1 μm, more preferably from 0.08 μm to 0.8 μm, and even more preferably from 0.1 μm to 0.6 μm.

Regarding the volume average particle diameter of the resin particles, a cumulative distribution by volume is drawn from the side of the smallest diameter with respect to particle size ranges (channels) separated using the particle size distribution obtained by the measurement with a laser diffraction-type particle size distribution measuring device (for example, LA-700 manufactured by Horiba, Ltd.), and a particle diameter when the cumulative percentage becomes 50% with respect to the entire particles is measured as a volume average particle diameter D50v. The volume average particle diameter of the particles in other dispersions is also measured in the same manner.

The content of the resin particles contained in the resin particle dispersion is, for example, preferably from 5% by weight to 50% by weight, and more preferably from 10% by weight to 40% by weight.

For example, the colorant particle dispersion and the release agent particle dispersion are also prepared in the same manner as in the case of the resin particle dispersion. That is, the particles in the resin particle dispersion are the same as the colorant particles dispersed in the colorant particle dispersion and the release agent particles dispersed in the release agent particle dispersion, in terms of the volume average particle diameter, the dispersion medium, the dispersing method, and the content of the particles.

First Aggregated Particle Forming Process

Next, the first resin particle dispersion and the colorant particle dispersion are mixed together.

The first resin particles and the colorant particles are heterogeneously aggregated in the dispersion mixture, and thereby first aggregated particles including first resin particles and colorant particles are formed.

Specifically, for example, an aggregating agent is added to the dispersion mixture and a pH of the dispersion mixture is adjusted to be acidic (for example, the pH is from 2 to 5). If necessary, a dispersion stabilizer is added. Then, the dispersion mixture is heated at the glass transition temperature of the first resin particles (specifically, for example, from a temperature 30° C. lower than the glass transition temperature of the first resin particles to a temperature 10° C. lower than the glass transition temperature thereof) to aggregate the particles dispersed in the dispersion mixture, and thereby the first aggregated particles are formed.

In the first aggregated particle forming process, for example, the aggregating agent maybe added at room temperature (for example, 25° C.) under stirring of the dispersion mixture using a rotary shearing-type homogenizer, the pH of the dispersion mixture may be adjusted to be acidic (for example, the pH is from 2 to 5), a dispersion stabilizer may be added if necessary, and then the heating may be performed.

Examples of the aggregating agent include a surfactant having an opposite polarity to the polarity of the surfactant used as the dispersing agent to be added to the dispersion mixture, an inorganic metal salt, and a bi- or higher-valent metal complex. Particularly, when a metal complex is used as the aggregating agent, the amount of the surfactant used is reduced and charging characteristics are improved.

If necessary, an additive may be used which forms a complex or a similar bond with the metal ions of the aggregating agent. A chelating agent is preferably used as the additive.

Examples of the inorganic metal salt include a metal salt such as calcium chloride, calcium nitrate, barium chloride, magnesium chloride, zinc chloride, aluminum chloride, and aluminum sulfate, and inorganic metal salt polymer such as polyaluminum chloride, polyaluminum hydroxide, and calcium polysulfide.

A water-soluble chelating agent may be used as the chelating agent. Examples of the chelating agent include oxycarboxylic acids such as tartaric acid, citric acid, and gluconic acid, iminodiacetic acid (IDA), nitrilotriacetic acid (NTA), and ethylenediaminetetraacetic acid (EDTA).

An addition amount of the chelating agent is, for example, preferably in a range of from 0.01 parts by weight to 5.0 parts by weight, and more preferably in a range of from 0.1 parts by weight to less than 3.0 parts by weight relative to 100 parts by weight of the first resin particles.

Second Aggregated Particle Forming Process

Next, after the first aggregated particle dispersion in which the first aggregated particles are dispersed is obtained, a dispersion mixture in which the second resin particles and the release agent particles are dispersed is sequentially added to the first aggregated particle dispersion while increasing the concentration of the release agent particles in the dispersion mixture slowly.

The second resin particles may be the same type as or a different type from the first resin particles.

The second resin particles and the release agent particles are aggregated on surfaces of the first aggregated particles in a dispersion in which the first aggregated particles, the second resin particles, and the release agent particles are dispersed. Specifically, for example, in the first aggregated particle forming process, when a particle diameter of the first aggregated particle reaches a desired particle diameter, a dispersion mixture in which the second resin particles and the release agent particles are dispersed is added to the first aggregated particle dispersion while increasing the concentration of the release agent particles slowly. The dispersion is heated at a temperature which is equal to or less than the glass transition temperature of the second resin particles.

For example, the pH of the dispersion is substantially in a range of from 6.5 to 8.5, and thus the progress of the aggregation is stopped.

Aggregated particles in which the second resin particles and the release agent particles are attached to the surfaces of the first aggregated particles are formed through this process. That is, second aggregated particles in which aggregates of the second resin particles and the release agent particles are attached to the surfaces of the first aggregated particles are formed. At this time, since the dispersion mixture in which the second resin particles and the release agent particles are dispersed is sequentially added to the first aggregated particle dispersion while increasing the concentration of the release agent particles in the dispersion mixture slowly, the concentration (existence ratio) of the release agent particles becomes slowly larger toward the radially outside direction of the particles, and the aggregates of the second resin particles and the release agent particles are attached to the surface of the first aggregated particle.

As a method of adding the dispersion mixture, a power feeding addition method may preferably be used. The dispersion mixture may be added to the first aggregated particle dispersion, with a gradual increase of the concentration of the release agent particles in the dispersion mixture, by using the power feeding addition method.

The method of adding the dispersion mixture using the power feeding addition method will be described with reference to the drawing.

Figure 2:
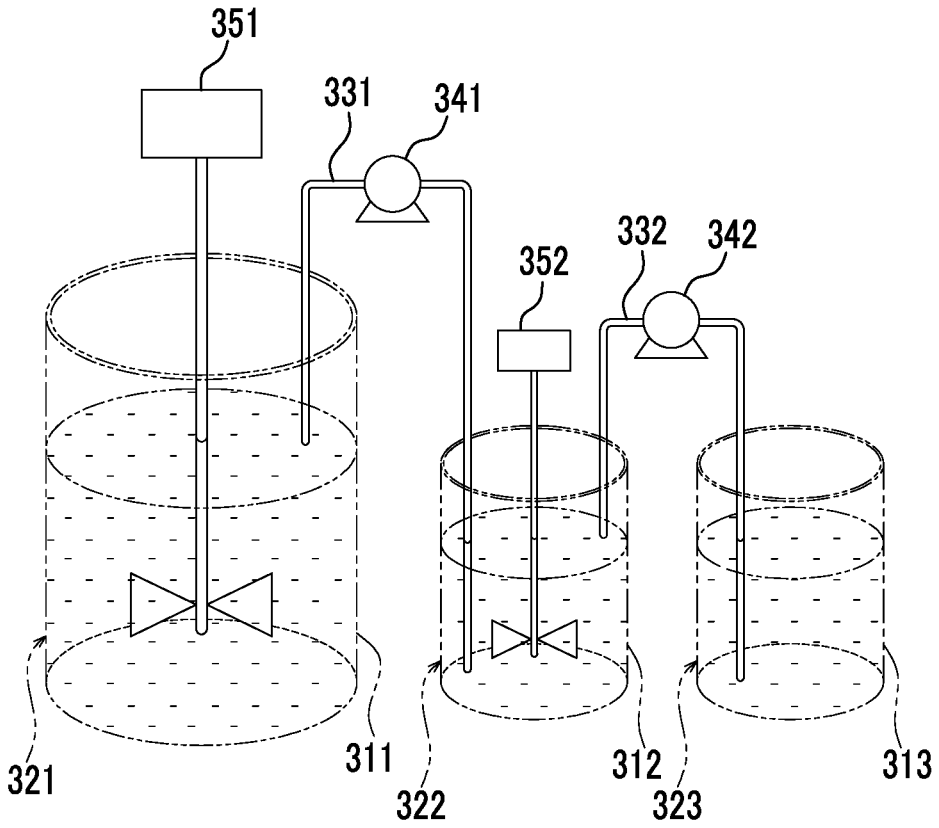
FIG. 2 is a schematic view for illustrating a power feed adding method.

FIG. 2 illustrates an apparatus used in the power feeding addition method. In FIG. 2, the reference numeral 311 indicates the first aggregated particle dispersion, the reference numeral 312 indicates the second resin particle dispersion, the reference numeral 313 indicates the release agent particle dispersion.

The apparatus illustrated in FIG. 2 includes a first storage tank 321, a second storage tank 322, and a third storage tank 323. In the first storage tank 321, the first aggregated particle dispersion in which the first aggregated particles are dispersed is stored. In the second storage tank 322, the second resin particle dispersion in which the second resin particles are dispersed is stored. In the third storage tank 323, the release agent particle dispersion in which the release agent particles are dispersed is stored.

The first storage tank 321 and the second storage tank 322 are linked to each other by using a first liquid transport tube 331. A first liquid transport pump 341 is provided in the middle of a path of the first liquid transport tube 331. Driving of the first liquid transport pump 341 causes the dispersion stored in the second storage tank 322 to be transported to the dispersion stored in the first storage tank 321 through the first liquid transport tube 331.

A first stirring apparatus 351 is disposed in the first storage tank 321. When driving of the first stirring apparatus 351 causes the dispersion stored in the second storage tank 322 to be transported to the dispersion stored in the first storage tank 321, the dispersions in the first storage tank 321 are stirred and mixed.

The second storage tank 322 and the third storage tank 323 are linked to each other by using a second liquid transport tube 332. A second liquid transport pump 342 is provided in the middle of a path of the second liquid transport tube 332. Driving of the second liquid transport pump 342 causes the dispersion stored in the third storage tank 323 to be transported to the dispersion stored in the second storage tank 322 through the second liquid transport tube 332.

A second stirring apparatus 352 is disposed in the second storage tank 322. When driving of the second stirring apparatus 352 causes the dispersion stored in the third storage tank 323 to be transported to the dispersion stored in the second storage tank 322, the dispersions in the second storage tank 322 are stirred and mixed.

In the apparatus illustrated in FIG. 2, first, the first aggregated particle forming process is performed and thereby a first aggregated particle dispersion is prepared, in the first storage tank 321. The first aggregated particle dispersion is stored in the first storage tank 321. The first aggregated particle forming process may be performed and thereby the first aggregated particle dispersion may be prepared in another tank, and then, the first aggregated particle dispersion may be stored in the first storage tank 321.

In this state, the first liquid transport pump 341 and the second liquid transport pump 342 are driven. This driving causes the second resin particle dispersion stored in the second storage tank 322 to be transported to the first aggregated particle dispersion stored in the first storage tank 321. Driving of the first stirring apparatus 351 causes the dispersions in the first storage tank 321 to be stirred and mixed.

The release agent particle dispersion stored in the third storage tank 323 is transported to the second resin particle dispersion stored in the second storage tank 322. Driving of the second stirring apparatus 352 causes the dispersions in the second storage tank 322 to be stirred and mixed.

At this time, the release agent particle dispersion is sequentially transported to the second resin particle dispersion stored in the second storage tank 322, and thus the concentration of the release agent particles becomes higher slowly. For this reason, the dispersion mixture in which second resin particles and the release agent particles are dispersed is stored in the second storage tank 322, and this dispersion mixture is transported to the first aggregated particle dispersion stored in the first storage tank 321. The dispersion mixture is continuously transported with an increase of the concentration of the release agent particle dispersion in the dispersion mixture.

In this manner, the dispersion mixture in which the second resin particles and the release agent particles are dispersed may be added to the first aggregated particle dispersion with a gradual increase of the concentration of the release agent particles, by using the power feeding addition method.

In the power feeding addition method, the distribution characteristics of the release agent domain of the toner are adjusted by adjusting liquid transport starting time and a liquid transport speed for each of the dispersions which are respectively stored in the second storage tank 322 and the third storage tank 323. In the power feeding addition method, also by adjusting the liquid transport speed in the process of transporting of the dispersions respectively stored in the second storage tank 322 and the third storage tank 323, the distribution characteristics of the release agent domain of the toner are adjusted.

Specifically, for example, the maximum frequent value in the distribution of the eccentricity B of the release agent domain is adjusted depending on a period of time when transporting of the release agent particle dispersion to the second storage tank 322 from the third storage tank 323 is ended. More specifically, for example, if transporting of the release agent particle dispersion to the second storage tank 322 from the third storage tank 323 is ended before liquid transporting to the first storage tank 321 from the second storage tank 322 is ended, the concentration of the release agent particles in the dispersion mixture of the second storage tank 322 does not increase from that point of time. Thus, the maximum frequent value in the distribution of the eccentricity B of the release agent domain becomes smaller.

For example, the skewness in the distribution of the eccentricity B of the release agent domain is adjusted depending on a period of time when the dispersions are respectively transported from the second storage tank 322 and the third storage tank 323, and a liquid transport speed at which the dispersion is transported to the first storage tank 321 from the second storage tank 322. More specifically, for example, if a liquid transport starting time of the release agent particle dispersion from the third storage tank 323 and a liquid transport starting time of the dispersion from the second storage tank 322 are early, and the liquid transport speed of the dispersion from the second storage tank 322 is lowered, a state where the release agent particles are disposed from a further inner side of the formed aggregated particle to a further outer side thereof is realized. Thus, the skewness in the distribution of the eccentricity B of the release agent domain becomes greater.

For example, the kurtosis in the distribution of the eccentricity B of the release agent domain is adjusted by changing the liquid transport speed of the release agent particle dispersion from the third storage tank 323 in the process of liquid transport. More specifically, for example, if only the liquid transport speed of the release agent particle dispersion from the third storage tank 323 becomes faster in the process of liquid transport, the concentration of the release agent particles in the dispersion of the second storage tank 322 becomes higher from that time. For this reason, there arises a state where many of the release agent particles are disposed in a certain area (certain deep portion) in a radial direction of the aggregated particle in the formed aggregated particle. Thus, the kurtosis in the distribution of the eccentricity B of the release agent domain becomes greater.

The above-described power feeding addition method is not limited to the above method. For example, various methods may be employed. Examples of the various methods include a method in which, a storage tank storing the second resin particle dispersion and a storage tank storing a dispersion mixture in which the second resin particles and the release agent particles are dispersed are separately provided and the respective dispersions are transported to the first storage tank 321 from the respective storage tanks while changing the liquid transport speed, a method in which a storage tank storing the release agent particle dispersion and a storage tank storing a dispersion mixture in which the second resin particles and the release agent particles are dispersed are separately provided, and the respective dispersions are transported to the first storage tank 321 from the respective storage tanks while changing the liquid transport speed, and the like.

As described above, the second aggregated particles in which the second resin particles and the release agent particles are attached to the surfaces of the first aggregated particles and aggregated are obtained.

Coalescence Process

Next, the second aggregated particle dispersion in which the second aggregated particles are dispersed is heated at, for example, a temperature that is equal to or higher than the glass transition temperature of the first and second resin particles (for example, a temperature that is higher than the glass transition temperature of the first and second resin particles by 10° C. to 30° C.) to coalesce the second aggregated particles and form toner particles.

The toner particles are obtained through the above-described processes.

After the aggregated particle dispersion in which the second aggregated particles are dispersed is obtained, toner particles may be prepared through the processes of:

further mixing the second aggregated particle dispersion with a third resin particle dispersion in which third resin particles corresponding to the binder resin are dispersed to perform aggregation so that the third resin particles further adhere to the surfaces of the second aggregated particles, thereby forming second aggregated particles; and coalescing the third aggregated particles by heating the third aggregated particle dispersion in which the third aggregated particles are dispersed, and thereby forming toner particles having a core/shell structure.

In the obtained toner particles (toner) by this operation, the maximum frequent value in the distribution of the eccentricity B of the release agent domain is equal to or less than 0.98.

After the coalescence process is ended, toner particles formed in a solution are subjected to a well-known washing process, a well-known solid-liquid separation process, a well-known drying process, and thereby dried toner particles are obtained.

Regarding the washing process, replacing washing using ion exchanged water may preferably be sufficiently performed for charging property. The solid-liquid separation process is not particularly limited, but suction filtration, pressure filtration, or the like may preferably be performed for productivity. The drying process is not particularly limited, but freeze drying, flash jet drying, fluidized drying, vibrating fluidized drying, and the like may preferably be performed for productivity.

The specific toner is prepared, for example, by adding an external additive to the obtained toner particles in a dried state, and performing mixing. The mixing may be performed, for example, by using a V blender, a HENSCHEL mixer, a LODIGE mixer, or the like. Furthermore, if necessary, coarse toner particles may be removed using a vibration sieving machine, a wind classifier, or the like.

In one toner of the related art, the release agent is positioned so as to be in the vicinity of a surface by using a difference in hydrophilic-hydrophobic properties between a binder resin and a release agent which are dissolved in a solvent. In the other toner of the related art, a release agent is positioned so as to be in the vicinity of a surface by using a kneading and pulverizing method with an uneven distribution-controlling resin, and the uneven distribution-controlling resin has both of a portion with a porality similar to a polarity of a binder resin and a portion with a porality similar to a polarity of the release agent. However, the above toners control a position of a release agent in a toner by using a physical property of a material and do not cause distribution of the release agent domain of a toner to have a gradient.

Electrostatic Charge Image Developer

An electrostatic charge image developer according to this exemplary embodiment includes at least the toner according to this exemplary embodiment.

The electrostatic charge image developer according to this exemplary embodiment may be a single-component developer including only the toner according to this exemplary embodiment, or a two-component developer obtained by mixing the toner with a carrier.

The carrier is not particularly limited, and known carriers are exemplified. Examples of the carrier include a coated carrier in which surfaces of cores formed of a magnetic powder are coated with a coating resin; a magnetic powder dispersion-type carrier in which a magnetic powder is dispersed and blended in a matrix resin; and a resin impregnation-type carrier in which a porous magnetic powder is impregnated with a resin.

The magnetic powder dispersion-type carrier and the resin impregnation-type carrier may be carriers in which constituent particles of the carrier are cores and coated with a coating resin.

Examples of the magnetic powder include magnetic metals such as iron, nickel, and cobalt, and magnetic oxides such as ferrite and magnetite.

Examples of the coating resin and the matrix resin include polyethylene, polypropylene, polystyrene, polyvinyl acetate, polyvinyl alcohol, polyvinyl butyral, polyvinyl chloride, polyvinyl ether, polyvinyl ketone, a vinyl chloride-vinyl acetate copolymer, a styrene-acrylic ester copolymer, a straight silicone resin configured to include an organosiloxane bond or a modified product thereof, a fluororesin, polyester, polycarbonate, a phenol resin, and an epoxy resin.

The coating resin and the matrix resin may contain other additives such as a conductive particles. Examples of the conductive particles include particles of metals such as gold, silver, and copper, carbon black particles, titanium oxide particles, zinc oxide particles, tin oxide particles, barium sulfate particles, aluminum borate particles, and potassium titanate particles.

Here, a coating method using a coating layer forming solution in which a coating resin, and if necessary, various additives are dissolved or dispersed in an appropriate solvent is used to coat the surface of a core with the coating resin. The solvent is not particularly limited, and may be selected in consideration of the coating resin to be used, coating suitability, and the like.

Specific examples of the resin coating method include a dipping method of dipping cores in a coating layer forming solution, a spraying method of spraying a coating layer forming solution to surfaces of cores, a fluid bed method of spraying a coating layer forming solution in a state in which cores are allowed to float by flowing air, and a kneader-coater method in which cores of a carrier and a coating layer forming solution are mixed with each other in a kneader-coater and the solvent is removed.

The mixing ratio (weight ratio) between the toner and the carrier in the two-component developer is preferably from 1:100 to 30:100, and more preferably from 3:100 to 20:100 (toner:carrier).

Image Forming Apparatus/Image Forming Method

An image forming apparatus and an image forming method according to this exemplary embodiment will be described.

The image forming apparatus according to this exemplary embodiment is provided with an image holding member, a charging unit that charges a surface of the image holding member, an electrostatic charge image forming unit that forms an electrostatic charge image on a charged surface of the image holding member, a developing unit that contains an electrostatic charge image developer and develops the electrostatic charge image formed on the surface of the image holding member with the electrostatic charge image developer to form a toner image, a transfer unit that transfers the toner image formed on the surface of the image holding member onto a surface of a recording medium, and a fixing unit that fixes the toner image transferred onto the surface of the recording medium. As the electrostatic charge image developer, the electrostatic charge image developer according to this exemplary embodiment is applied.

In the image forming apparatus according to this exemplary embodiment, an image forming method (image forming method according to this exemplary embodiment) including a charging process of charging a surface of an image holding member, an electrostatic charge image forming process of forming an electrostatic charge image on a charged surface of the image holding member, a developing process of developing the electrostatic charge image formed on the surface of the image holding member with the electrostatic charge image developer according to this exemplary embodiment to form a toner image, a transfer process of transferring the toner image formed on the surface of the image holding member onto a surface of a recording medium, and a fixing process of fixing the toner image transferred onto the surface of the recording medium is performed.

As the image forming apparatus according to this exemplary embodiment, a known image forming apparatus is applied, such as a direct transfer-type apparatus that directly transfers a toner image formed on a surface of an image holding member onto a recording medium; an intermediate transfer-type apparatus that primarily transfers a toner image formed on a surface of an image holding member onto a surface of an intermediate transfer member, and secondarily transfers the toner image transferred onto the surface of the intermediate transfer member onto a surface of a recording medium; an apparatus that is provided with a cleaning unit that cleans a surface of an image holding member after transfer of a toner image and before charging; or an apparatus that is provided with an erasing unit that irradiates, after transfer of a toner image and before charging, a surface of an image holding member with erasing light for erasing.

In the case of an intermediate transfer-type apparatus, a transfer unit has, for example, an intermediate transfer member having a surface onto which a toner image is to be transferred, a primary transfer unit that primarily transfers a toner image formed on a surface of an image holding member onto the surface of the intermediate transfer member, and a secondary transfer unit that secondarily transfers the toner image transferred onto the surface of the intermediate transfer member onto a surface of a recording medium.

In the image forming apparatus according to this exemplary embodiment, for example, a part including the developing unit may have a cartridge structure (process cartridge) that is detachable from the image forming apparatus. As the process cartridge, for example, a process cartridge that stores the electrostatic charge image developer according to this exemplary embodiment and is provided with a developing unit is preferably used.

Hereinafter, an example of the image forming apparatus according to this exemplary embodiment will be shown. However, this image forming apparatus is not limited thereto. Major parts shown in the drawing will be described, but descriptions of other parts will be omitted.

Figure 3:
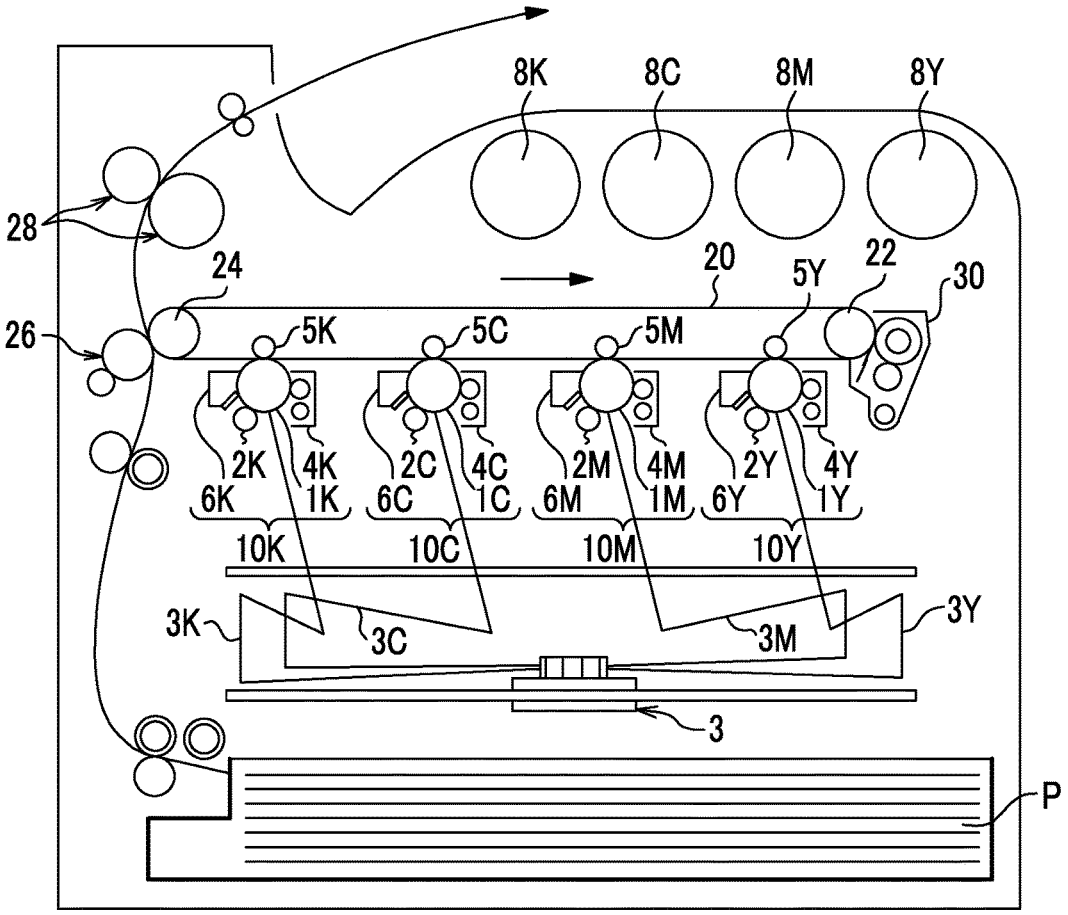
FIG. 3 is a schematic configuration diagram showing an example of an image forming apparatus according to the exemplary embodiment.

FIG. 3 is a schematic diagram showing a configuration of the image forming apparatus according to this exemplary embodiment.

The image forming apparatus shown in FIG. 3 is provided with first to fourth electrophotographic image forming units 10Y, 10M, 10C, and 10K (image forming units) that output yellow (Y), magenta (M), cyan (C), and black (K) images based on color-separated image data, respectively. These image forming units (hereinafter, may be simply referred to as "units") 10Y, 10M, 10C, and 10K are arranged side by side at predetermined intervals in a horizontal direction. These units 10Y, 10M, 10C, and 10K may be process cartridges that are detachable from the image forming apparatus.

An intermediate transfer belt 20 as an intermediate transfer member is installed above the units 10Y, 10M, 10C, and 10K in the drawing to extend through the units. The intermediate transfer belt 20 is wound on a driving roll 22 and a support roll 24 contacting the inner surface of the intermediate transfer belt 20, which are disposed to be separated from each other on the left and right sides in the drawing, and travels in a direction toward the fourth unit 10K from the first unit 10Y. The support roll 24 is pressed in a direction in which it departs from the driving roll 22 by a spring or the like (not shown), and a tension is given to the intermediate transfer belt 20 wound on both of the rolls. In addition, an intermediate transfer member cleaning device 30 opposed to the driving roll 22 is provided on a surface of the intermediate transfer belt 20 on the image holding member side.

Developing devices (developing units) 4Y, 4M, 4C, and 4K of the units 10Y, 10M, 10C, and 10K are supplied with toner including four color toner, that is, a yellow toner, a magenta toner, a cyan toner, and a black toner stored in toner cartridges 8Y, 8M, 8C, and 8K, respectively.

The first to fourth units 10Y, 10M, 10C, and 10K have the same configuration, and accordingly, only the first unit 10Y that is disposed on the upstream side in a traveling direction of the intermediate transfer belt to form a yellow image will be representatively described herein. The same parts as in the first unit 10Y will be denoted by the reference numerals with magenta (M), cyan (C), and black (K) added instead of yellow (Y), and descriptions of the second to fourth units 10M, 10C, and 10K will be omitted.

The first unit 10Y has a photoreceptor 1Y acting as an image holding member. Around the photoreceptor 1Y, a charging roll (an example of the charging unit) 2Y that charges a surface of the photoreceptor 1Y to a predetermined potential, an exposure device (an example of the electrostatic charge image forming unit) 3 that exposes the charged surface with laser beams 3Y based on a color-separated image signal to form an electrostatic charge image, a developing device (an example of the developing unit) 4Y that supplies a charged toner to the electrostatic charge image to develop the electrostatic charge image, a primary transfer roll (an example of the primary transfer unit) 5Y that transfers the developed toner image onto the intermediate transfer belt 20, and a photoreceptor cleaning device (an example of the cleaning unit) 6Y that removes the toner remaining on the surface of the photoreceptor 1Y after primary transfer, are arranged in sequence.

The primary transfer roll 5Y is disposed inside the intermediate transfer belt 20 to be provided at a position opposed to the photoreceptor 1Y. Furthermore, bias supplies (not shown) that apply a primary transfer bias are connected to the primary transfer rolls 5Y, 5M, 5C, and 5K, respectively. Each bias supply changes a transfer bias that is applied to each primary transfer roll under the control of a controller (not shown).

Hereinafter, an operation of forming a yellow image in the first unit 10Y will be described.

First, before the operation, the surface of the photoreceptor 1Y is charged to a potential of −600 V to −800 V by the charging roll 2Y.

The photoreceptor 1Y is formed by laminating a photosensitive layer on a conductive substrate (for example, volume resistivity at 20° C.: $1\times10^{-6}$ Ωcm or less). The photosensitive layer typically has high resistance (that is about the same as the resistance of a general resin), but has properties in which when laser beams 3Y are applied, the specific resistance of a part irradiated with the laser beams changes. Accordingly, the laser beams 3Y are output to the charged surface of the photoreceptor 1Y via the exposure device 3 in accordance with image data for yellow sent from the controller (not shown). The laser beams 3Y are applied to the photosensitive layer on the surface of the photoreceptor 1Y, whereby an electrostatic charge image of a yellow image pattern is formed on the surface of the photoreceptor 1Y.

The electrostatic charge image is an image that is formed on the surface of the photoreceptor 1Y by charging, and is a so-called negative electrostatic charge image, that is formed by applying laser beams 3Y to the photosensitive layer so that the specific resistance of the irradiated part is lowered to cause charges to flow on the surface of the photoreceptor 1Y, while charges stay on a part to which the laser beams 3Y are not applied.

The electrostatic charge image formed on the photoreceptor 1Y is rotated up to a predetermined developing position with the travelling of the photoreceptor 1Y. The electrostatic charge image on the photoreceptor 1Y is visualized (developed) as a toner image at the developing position by the developing device 4Y.

The developing device 4Y stores, for example, an electrostatic charge image developer including at least a yellow toner and a carrier. The yellow toner is frictionally charged by being agitated in the developing device 4Y to have a charge with the same polarity (negative polarity) as the charge that is on the photoreceptor 1Y, and is thus held on the developer roll (an example of the developer holding member). By allowing the surface of the photoreceptor 1Y to pass through the developing device 4Y, the yellow toner electrostatically adheres to the erased electrostatic charge image part on the surface of the photoreceptor 1Y, whereby the electrostatic charge image is developed with the yellow toner. Next, the photoreceptor 1Y having the yellow toner image formed thereon continuously travels at a predetermined rate and the toner image developed on the photoreceptor 1Y is transported to a predetermined primary transfer position.

When the yellow toner image on the photoreceptor 1Y is transported to the primary transfer position, a primary transfer bias is applied to the primary transfer roll 5Y and an electrostatic force toward the primary transfer roll 5Y from the photoreceptor 1Y acts on the toner image, whereby the toner image on the photoreceptor 1Y is transferred onto the intermediate transfer belt 20. The transfer bias applied at this time has the opposite polarity (+) to the toner polarity (−), and, for example, is controlled to +10 μA in the first unit 10Y by the controller (not shown).

On the other hand, the toner remaining on the photoreceptor 1Y is removed and collected by the photoreceptor cleaning device 6Y.

The primary transfer biases that are applied to the primary transfer rolls 5M, 5C, and 5K of the second unit 10M and the subsequent units are also controlled in the same manner as in the case of the first unit.

In this manner, the intermediate transfer belt 20 onto which the yellow toner image is transferred in the first unit 10Y is sequentially transported through the second to fourth units 10M, 10C, and 10K, and the toner images of respective colors are multiply-transferred in a superimposed manner.

The intermediate transfer belt 20 onto which the four color toner images have been multiply-transferred through the first to fourth units reaches a secondary transfer part that is composed of the intermediate transfer belt 20, the support roll 24 contacting the inner surface of the intermediate transfer belt, and a secondary transfer roll (an example of the secondary transfer unit) 26 disposed on the image holding surface side of the intermediate transfer belt 20. Meanwhile, a recording sheet (an example of the recording medium) P is supplied to a gap between the secondary transfer roll 26 and the intermediate transfer belt 20, that are brought into contact with each other, via a supply mechanism at a predetermined timing, and a secondary transfer bias is applied to the support roll 24. The transfer bias applied at this time has the same polarity (−) as the toner polarity (−), and an electrostatic force toward the recording sheet P from the intermediate transfer belt 20 acts on the toner image, whereby the toner image on the intermediate transfer belt 20 is transferred onto the recording sheet P. In this case, the secondary transfer bias is determined depending on the resistance detected by a resistance detector (not shown) that detects the resistance of the secondary transfer part, and is voltage-controlled.

Thereafter, the recording sheet P is fed to a pressure-contacting part (nip part) between a pair of fixing rolls in a fixing device (an example of the fixing unit) 28 so that the toner image is fixed to the recording sheet P, whereby a fixed image is formed.

Examples of the recording sheet P onto which a toner image is transferred include plain paper that is used in electrophotographic copiers, printers, and the like. As a recording medium, an OHP sheet is also exemplified other than the recording sheet P.

The surface of the recording sheet P is preferably smooth in order to further improve smoothness of the image surface after fixing. For example, coating paper obtained by coating a surface of plain paper with a resin or the like, art paper for printing, and the like are preferably used.

The recording sheet P on which the fixing of the color image is completed is discharged toward a discharge part, and a series of the color image forming operations end.

Process Cartridge/Toner Cartridge

A process cartridge according to this exemplary embodiment will be described.

The process cartridge according to this exemplary embodiment is provided with a developing unit that stores the electrostatic charge image developer according to this exemplary embodiment and develops an electrostatic charge image formed on a surface of an image holding member with the electrostatic charge image developer to form a toner image, and is detachable from an image forming apparatus.

The process cartridge according to this exemplary embodiment is not limited to the above-described configuration, and may be configured to include a developing device, and if necessary, at least one selected from other units such as an image holding member, a charging unit, an electrostatic charge image forming unit, and a transfer unit.

Hereinafter, an example of the process cartridge according to this exemplary embodiment will be shown. However, this process cartridge is not limited thereto. Major parts shown in the drawing will be described, but descriptions of other parts will be omitted.

Figure 4:
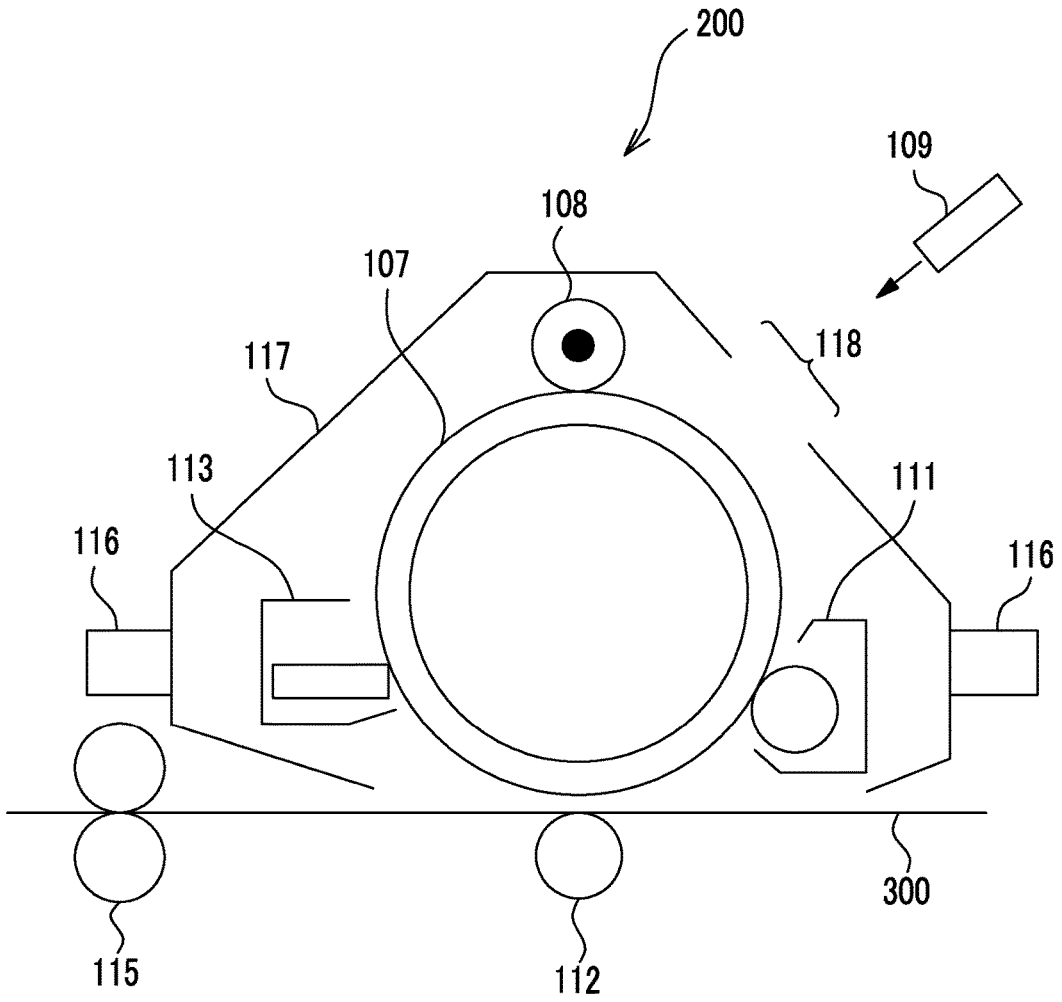
FIG. 4 is a schematic configuration diagram showing an example of a process cartridge according to the exemplary embodiment.

FIG. 4 is a schematic diagram showing a configuration of the process cartridge according to this exemplary embodiment.

A process cartridge 200 shown in FIG. 4 is formed as a cartridge having a configuration in which a photoreceptor 107 (an example of the image holding member), a charging roll 108 (an example of the charging unit), a developing device 111 (an example of the developing unit), and a photoreceptor cleaning device 113 (an example of the cleaning unit), which are provided around the photoreceptor 107, are integrally combined and held by the use of, for example, a housing 117 provided with a mounting rail 116 and an opening 118 for exposure.

In FIG. 4, the reference numeral 109 represents an exposure device (an example of the electrostatic charge image forming unit), the reference numeral 112 represents a transfer device (an example of the transfer unit), the reference numeral 115 represents a fixing device (an example of the fixing unit), and the reference numeral 300 represents a recording sheet (an example of the recording medium).

Next, a toner cartridge according to this exemplary embodiment will be described.

The toner cartridge according to this exemplary embodiment stores the toner according to this exemplary embodiment and is detachable from an image forming apparatus. The toner cartridge stores a toner in a storing portion for replenishment for being supplied to the developing unit provided in the image forming apparatus.

The image forming apparatus shown in FIG. 3 has such a configuration that the toner cartridges 8Y, 8M, 8C, and 8K are detachable therefrom, and the developing devices 4Y, 4M, 4C, and 4K are connected to the toner cartridges corresponding to the respective developing devices (colors) via toner supply tubes (not shown), respectively. In addition, when the toner stored in the toner cartridge runs low, the toner cartridge is replaced.

Hereinafter, the exemplary embodiment will be described in detail using examples but the exemplary embodiment is not limited to the examples. Unless specifically noted, "parts" and "%" are based on weight.

Preparation of Resin Particle Dispersion

Preparation of Resin Particle Dispersion (1)

Terephthalic acid: 20 parts by mol

Fumaric acid: 80 parts by mol

Ethylene oxide adduct of Bisphenol A: 5 parts by mol

Propylene oxide adduct of Bisphenol A: 95 parts by mol

The above materials are charged into a 5-liter flask including a stirrer, a nitrogen gas introducing tube, a temperature sensor, and a rectifying column, the temperature is increased to 210° C. over 1 hour, and 1 part of titanium tetraethoxide is added to 100 parts of the above materials. The temperature is increased to 230° C. over 0.5 hours while distilling away generated water, a dehydration condensation reaction is continued at this temperature for 1 hour, and then the resultant is cooled. Thus, a polyester resin (1) having a weight average molecular weight of 18,500, an acid value of 14 mgKOH/g, and a glass transition temperature of 49° C. is synthesized.

40 parts of ethyl acetate and 25 parts of 2-butanol are added to a vessel including a temperature adjustment unit and a nitrogen substitution unit to prepare a mixed solution, 100 parts of the polyester resin (1) is slowly added and dissolved in the mixed solution, and 10% ammonia aqueous solution (which corresponds to the molar amount of three times the acid value of the resin) is added thereto and stirred for 30 minutes.

Then, the atmosphere in the vessel is substituted with dry nitrogen, the temperature is maintained at 40° C., and 400 parts of ion exchange water is added dropwise thereto at a rate of 2 part/min while stirring the mixed solution, to thereby perform emulsification. After the addition, the temperature of the emulsified solution is returned to room temperature (20° C. to 25° C.), and bubbling is performed with dry nitrogen for 48 hours while stirring, to thereby decrease the content of ethyl acetate and 2-butanol to be equal to or smaller than 1,000 ppm based on weight and thus, a resin particle dispersion in which resin particles having a volume average particle diameter of 200 nm are dispersed is obtained. Ion exchange water is added to the resin particle dispersion to adjust solid component amount to 20 weight %. Thus, a resin particle dispersion (1) is obtained.

Preparation of Resin Particle Dispersion (2)

Terephthalic acid: 80 parts by mol

Fumaric acid: 20 parts by mol

Ethylene oxide adduct of Bisphenol A: 5 parts by mol

Propylene oxide adduct of Bisphenol A: 95 parts by mol

A polyester resin (2) is synthesized in the same manner as in the synthesis of the polyester resin (1) except for changing the materials as described above, and a resin particle dispersion (2) is prepared in the same manner as in the preparation of the resin particle dispersion (1) except for using the polyester resin (2) in place of the polyester resin (1). The weight average molecular weight of the polyester resin (2) is 19,000, the acid value thereof is 15 mgKOH/g, and the glass transition temperature is 81° C.

Preparation of Colorant Particle Dispersion

Preparation of Colorant Particle Dispersion (1)

Cyan pigment C.I. Pigment Blue 15:3 (copper phthalocyanine manufactured by DIC, product name: FASTOGEN BLUE LA5380): 70 parts Anionic surfactant (NEOGEN RK manufactured by Dai-Ichi Kogyo Seiyaku Co., Ltd.): 5 parts Ion exchange water: 200 parts The above materials are mixed with each other and dispersed using a homogenizer (ULTRA TURRAX T50 manufactured by IKA Japan, K.K.) for 10 minutes. Ion exchange water is added to the dispersion so that the solid component amount becomes 20% by weight. Thus, a colorant particle dispersion (1) in which colorant particles having a volume average particle diameter of 190 nm are dispersed is obtained.

Preparation of Release Agent Particle Dispersion

Preparation of Release Agent Particle Dispersion (1)

Paraffin Wax (HNP-9 manufactured by Nippon Seiro Co., Ltd.): 100 parts

Anionic surfactant (NEOGEN RK manufactured by Dai-Ichi Kogyo Seiyaku Co., Ltd.): 1 part Ion exchange water: 350 parts The above materials are mixed with each other, heated to 100° C., and dispersed using a homogenizer (ULRA TURRAX T50 manufactured by IKA Japan, K.K.). After that, the mixture is subject to dispersion treatment with Manton-Gaulin high pressure homogenizer (manufactured by Gaulin Co., Ltd.). Thus, a release agent particle dispersion (1) (solid component amount of 20%) in which release agent particles having a volume average particle diameter of 200 nm are dispersed is obtained.

EXAMPLE 1

Preparation of Toner Particles

An apparatus (see FIG. 2) which connects a round stainless steel flask and a container A of a polyester bottle to each other through a tube pump A, transports a solution stored in the container A to the flask by the driving of the tube pump A, connects the container A and a container B of a polyester bottle to each other through a tube pump B, and transports a solution stored in the container B to the container A by the driving of the tube pump B is prepared. The following operations are performed using this apparatus.

Resin particle dispersion (1): 400 parts

Resin particle dispersion (2): 100 parts

Colorant particle dispersion (1): 40 parts

Anionic surfactant (TAYCAPOWER): 2 parts

The above materials are put into the round stainless steel flask, 0.1 N of nitric acid is added to adjust the pH to 3.5, and then, 30 parts of a nitric acid aqueous solution containing 10% polyaluminum chloride is added. Then, the resultant material is dispersed at 30° C. using a homogenizer (ULTRA TURRAX T50 manufactured by IKA Japan, K.K.) and the temperature is increased at a rate of 1° C./30 min in a heating oil bath to thereby increase a particle diameter of aggregated particles.

Meanwhile, 100 parts of the resin particle dispersion (1) and 50 parts of the resin particle dispersion (2) are put into the container A, and 25 parts of the release agent particle dispersion (1) is put into the container B. Then, a solution transport speed of the tube pump A is set as 0.55 part/min, a solution transport speed of the tube pump B is set as 0.14 part/min. At the time when a temperature in the round stainless steel flask during the formation of aggregating particles reached 37.0° C., the tube pumps A and B are set to be driven and transporting of each dispersion is thereby started. Accordingly, a mixed dispersion in which the resin particles and the release agent particles are dispersed is transported to the round stainless steel flask during the formation of the aggregated particles from the container A, while slowly increasing concentration of the release agent particles.

The transporting of each dispersion to the flask is completed, and after the temperature in the flask becomes 48° C., the resultant material is allowed to stand for 30 minutes. Thus, the second aggregated particles are formed.

After that, 25 parts of the resin particle dispersion (1) and 25 parts of the resin particle dispersion (2) are added thereto and maintained for 1 hour. After adjusting the pH to 8.5 by adding 0.1 N sodium hydroxide aqueous solution, the temperature is increased to 85° C. with continuous stirring, and maintained for 5 hours. Then, the temperature is decreased to 20° C. at a rate of 20° C./min, the resultant is filtered, sufficiently washed with ion exchange water, and dried, to thereby obtain toner particles (1) having a volume average particle diameter of 6.0 μm.

Preparation of Toner 100 parts of the toner particles (1) and 0.7 parts of dimethyl silicone oil-treated silica particles (RY 200 manufactured by Nippon Aerosil co. Ltd.) are mixed with each other using a HENSCHEL mixer (peripheral speed of 30 m/sec for 3 minutes) to thereby obtain a toner (1).

Preparation of Developer

Ferrite particles (average particle diameter of 50 μm): 100 parts

Toluene: 14 parts

Styrene-methyl methacrylate copolymer (copolymerization ratio of 15/85): 3 parts Carbon black: 0.2 parts The above components excluding the ferrite particles are dispersed by a sand mill to prepare dispersion, this dispersion and the ferrite particles are put into a vacuum degassing type kneader, stirred and dried under the reduced pressure to thereby obtain a carrier.

8 parts of the toner (1) is mixed with 100 parts of the carrier to thereby obtain a developer (1).

Various Measurement

The maximum frequent value and the skewness in distribution of the eccentricity B of the release agent domain, the elevated flow tester melt viscosity, and the flow activation energy regarding the toners obtained in Examples and Comparative Examples are measured according to the methods described above. The results thereof are shown in Table 1.

Evaluation

The following evaluation is performed using the developer obtained in each example. The results are shown in Table 1.

The following operation and the image forming are performed in the environment of temperature of 25° C. and humidity of 60%.

An apparatus obtained by modifying 700 DIGITAL COLOR PRESS manufactured by Fuji Xerox Co., Ltd. so as to print an unfixed image up to ends of a sheet is prepared as an image forming apparatus which forms an image for evaluating minute white spots and uneven glossiness, the developer is put into a developing device, and replenishment toner (same toner as the toner contained in the developer) is put into a toner cartridge. Then, an entirely solid image having a toner amount of 10 g/m$^2$ is formed on a rough sheet (P sheet manufactured by Fuji Xerox Co., Ltd.) and 100 sheets are continuously printed by setting a fixing temperature to 180° C. and a process speed to 220 mm/sec. The evaluations of minute white spots and uneven glossiness are performed with respect to the obtained images on the 100th sheet.

Minute White Spots

The obtained images are visually observed and evaluation is performed based on the following criteria. The obtained results are shown in Table 1.

Evaluation Criteria of Minute White Spots

A: no minute white spots are observed.

B: minute white spots are observed (1 to 3 spots) but no problem on the practical use.

C: plural minute white spots are observed (equal to or more than 4 spots) and cause a problem on the practical use are not in an acceptable range.

The minute white spots are white spots having a size of several tens μm to 100 μm in a solid image.

Uneven Glossiness

Evaluation of Uneven Glossiness

Measurement of 60 degree glossiness is performed with respect to the obtained image using a portable glossmeter (BYK Gardner micro-tri gloss meter manufactured by Toyo Seiki Seisaku-Sho). When a side of the sheet in a transporting direction is set as a front end, the measurement is performed 10 times arbitrarily in five portions of a left front end, a right front end, a left rear end, a right rear end, and a center portion of the image, and a standard deviation σ of data regarding total 50 obtained gloss values is obtained and is set as an index of uneven glossiness. The obtained results are shown in Table 1. Levels higher than B are acceptable levels.

A: $\sigma<3.0$

B: $3.0\leq\sigma\leq5.0$

C: $5.0\leq\sigma\leq8.0$

D: $8.0\leq\sigma$

Hot Offsetting

Evaluation of Hot Offsetting Resistance

An image having an end margin of 2 mm and a toner amount of 10 g/m$^2$ is printed over the entire surface of a sheet (P paper manufactured by Fuji Xerox Co., Ltd.) using the image forming apparatus, a setting temperature of the surface of a fixing roll of a fixing device is slowly changed in a range of 100° C. to 220° C. for each printing, occurrence of hot offsetting at each temperature (a phenomenon in which peeling properties in a high temperature portion at the time of fixing is deteriorated and an image is fused to a fixing member) is checked, and evaluation is performed based on the following evaluation criteria. When checking the occurrence of offsetting, measurement regarding a white portion of the sheet is performed using a density measurement device X-lite 404, and the measured numerical value is acceptable, when it is equal to or smaller than 0.05. The evaluation criteria are as follows. The obtained results are shown in Table 1. Levels higher than B are acceptable levels.

A: hot offsetting occurrence temperature is equal to or higher than 210° C.

B: hot offsetting occurrence temperature is equal to or higher than 190° C. and lower than 210° C.

C: hot offsetting occurrence temperature is equal to or higher than 170° C. and lower than 190° C.

D: hot offsetting occurrence temperature is lower than 170° C.

EXAMPLE 2

Toner particles (2) are obtained in the same manner as in the preparation of the toner particles (1) of Example 1, except for changing the amount of resin particle dispersion (1) put into the round stainless steel flask to 250 parts, the amount of resin particle dispersion (2) to 250 parts, the amount of resin particle dispersion (1) put into the container A to 75 parts, the amount of the resin particle dispersion (2) to 75 parts, and the solution transport speed of the tube pump A to 0.70 part/min. A volume average particle diameter of the obtained toner particles (2) is 5.9 μm. A toner (2) and a developer (2) are obtained using the toner particles (2) in the same manner as in Example 1.

EXAMPLE 3

Toner particles (3) are obtained in the same manner as in the preparation of the toner particles (2) of Example 2, except for changing the amount of resin particle dispersion (1) put into the round stainless steel flask to 400 parts, the amount of resin particle dispersion (2) to 100 parts, the amount of resin particle dispersion (1) put into the container A to 100 parts, and the amount of the resin particle dispersion (2) to 50 parts. A volume average particle diameter of the obtained toner particles (3) is 5.8 μm. A toner (3) and a developer (3) are obtained using the toner particles (3) in the same manner as in Example 1.

EXAMPLE 4

Toner particles (4) are obtained in the same manner as in the preparation of the toner particles (2) of Example 2, except for changing the amount of resin particle dispersion (1) put into the round stainless steel flask to 100 parts, the amount of resin particle dispersion (2) to 400 parts, the amount of resin particle dispersion (1) put into the container A to 50 parts, and the amount of the resin particle dispersion (2) to 100 parts. A volume average particle diameter of the obtained toner particles (4) is 5.8 μm. A toner (4) and a developer (4) are obtained using the toner particles (4) in the same manner as in Example 1.

EXAMPLE 5

Toner particles (5) are obtained in the same manner as in the preparation of the toner particles (2) of Example 2, except for changing the amount of resin particle dispersion (1) put into the container A to 20 parts and the amount of the resin particle dispersion (2) to 130 parts. A volume average particle diameter of the obtained toner particles (5) is 5.9 μm. A toner (5) and a developer (5) are obtained using the toner particles (5) in the same manner as in Example 1.

EXAMPLE 6

Toner particles (6) are obtained in the same manner as in the preparation of the toner particles (2) of Example 2, except for changing the amount of resin particle dispersion (1) put into the container A to 130 parts and the amount of the resin particle dispersion (2) to 20 parts. A volume average particle diameter of the obtained toner particles (6) is 5.6 μm. A toner (6) and a developer (6) are obtained using the toner particles (6) in the same manner as in Example 1.

EXAMPLE 7

Toner particles (7) are obtained in the same manner as in the preparation of the toner particles (2) of Example 2, except for changing the transmission starting temperature of the tube pump A to 33° C. A volume average particle diameter of the obtained toner particles (7) is 6.2 μm. A toner (7) and a developer (7) are obtained using the toner particles (7) in the same manner as in Example 1.

EXAMPLE 8

Toner particles (8) are obtained in the same manner as in the preparation of the toner particles (2) of Example 2, except for changing the transmission starting temperature of the tube pump A to 39° C. A volume average particle diameter of the obtained toner particles (8) is 5.4 μm. A toner (8) and a developer (8) are obtained using the toner particles (8) in the same manner as in Example 1.

EXAMPLE 9

Toner particles (9) are obtained in the same manner as in the preparation of the toner particles (2) of Example 2, except for changing the transport speed of the tube pump A to 0.54 part/min. A volume average particle diameter of the obtained toner particles (9) is 6.2 μm. A toner (9) and a developer (9) are obtained using the toner particles (9) in the same manner as in Example 1.

EXAMPLE 10

Toner particles (10) are obtained in the same manner as in the preparation of the toner particles (2) of Example 2, except for changing the transport speed of the tube pump A to 0.82 part/min. A volume average particle diameter of the obtained toner particles (10) is 5.5 μm. A toner (10) and a developer (10) are obtained using the toner particles (10) in the same manner as in Example 1.

COMPARATIVE EXAMPLE 1

Toner particles (11) are obtained in the same manner as in the preparation of the toner particles (2) of Example 2, except for changing the amount of resin particle dispersion (1) put into the round stainless steel flask to 480 parts, the amount of resin particle dispersion (2) to 20 parts, the amount of resin particle dispersion (1) put into the container A to 140 parts, and the amount of the resin particle dispersion (2) to 10 parts. A volume average particle diameter of the obtained toner particles (11) is 5.8 μm. A toner (11) and a developer (11) are obtained using the toner particles (11) in the same manner as in Example 1.

COMPARATIVE EXAMPLE 2

Toner particles (12) are obtained in the same manner as in the preparation of the toner particles (2) of Example 2, except for changing the amount of resin particle dispersion (1) put into the round stainless steel flask to 20 parts, the amount of resin particle dispersion (2) to 480 parts, the amount of resin particle dispersion (1) put into the container A to 10 parts, and the amount of the resin particle dispersion (2) to 140 parts. A volume average particle diameter of the obtained toner particles (12) is 5.7 μm. A toner (12) and a developer (12) are obtained using the toner particles (12) in the same manner as in Example 1.

COMPARATIVE EXAMPLE 3

Toner particles (13) are obtained in the same manner as in the preparation of the toner particles (2) of Example 2, except for the amount of resin particle dispersion (1) put into the container A to 5 parts and the amount of the resin particle dispersion (2) to 145 parts. A volume average particle diameter of the obtained toner particles (13) is 5.6 μm. A toner (13) and a developer (13) are obtained using the toner particles (13) in the same manner as in Example 1.

COMPARATIVE EXAMPLE 4

Toner particles (14) are obtained in the same manner as in the preparation of the toner particles (2) of Example 2, except for the amount of resin particle dispersion (1) put into the container A to 145 parts and the amount of the resin particle dispersion (2) to 5 parts. A volume average particle diameter of the obtained toner particles (14) is 5.6 μm. A toner (14) and a developer (14) are obtained using the toner particles (14) in the same manner as in Example 1.

COMPARATIVE EXAMPLE 5

Toner particles (15) are obtained in the same manner as in the preparation of the toner particles (2) of Example 2, except for changing the transmission starting temperature of the tube pump A to 31° C. A volume average particle diameter of the obtained toner particles (15) is 5.8 μm. A toner (15) and a developer (15) are obtained using the toner particles (15) in the same manner as in Example 1.

COMPARATIVE EXAMPLE 6

Toner particles (16) are obtained in the same manner as in the preparation of the toner particles (2) of Example 2, except for changing the transmission starting temperature of the tube pump A to 40° C. A volume average particle diameter of the obtained toner particles (16) is 5.9 μm. A toner (16) and a developer (16) are obtained using the toner particles (16) in the same manner as in Example 1.

COMPARATIVE EXAMPLE 7

Toner particles (17) are obtained in the same manner as in the preparation of the toner particles (2) of Example 2, except for changing the transport speed of the tube pump A to 0.50 part/min. A volume average particle diameter of the obtained toner particles (17) is 6.4 μm. A toner (17) and a developer (17) are obtained using the toner particles (17) in the same manner as in Example 1.

COMPARATIVE EXAMPLE 8

Toner particles (18) are obtained in the same manner as in the preparation of the toner particles (2) of Example 2, except for changing the transport speed of the tube pump A to 0.90 part/min. A volume average particle diameter of the obtained toner particles (18) is 6.2 μm. A toner (18) and a developer (18) are obtained using the toner particles (18) in the same manner as in Example 1.

TABLE 1

| | Sea-island structure | Melt viscosity (Pa · s) | Flow activation energy (J · mol$^{-1}$) | Maximum frequent value | Skewness | Minute white spots | Uneven glossiness | Hot offsetting |
|---|---|---|---|---|---|---|---|---|
| Ex. 1 | Obtained | 4200 | 41000 | 0.85 | −1.08 | A | A | B |
| Ex. 2 | Obtained | 35000 | 46000 | 0.88 | −0.78 | A | A | A |
| Ex. 3 | Obtained | 4100 | 45000 | 0.86 | −0.80 | A | B | B |
| Ex. 4 | Obtained | 198000 | 42000 | 0.84 | −0.76 | B | A | A |
| Ex. 5 | Obtained | 34000 | 18500 | 0.88 | −0.77 | B | A | A |
| Ex. 6 | Obtained | 40000 | 79600 | 0.86 | −0.73 | A | B | A |
| Ex. 7 | Obtained | 39000 | 39000 | 0.76 | −0.78 | B | A | B |
| Ex. 8 | Obtained | 38000 | 40000 | 0.98 | −0.79 | A | B | A |
| Ex. 9 | Obtained | 32000 | 44000 | 0.80 | −1.09 | A | B | A |
| Ex. 10 | Obtained | 39000 | 45000 | 0.85 | −0.51 | B | A | A |
| Com. Ex. 1 | Obtained | 3900 | 38000 | 0.80 | −0.74 | B | C | D |
| Com. Ex. 2 | Obtained | 200500 | 37000 | 0.85 | −0.78 | C | B | A |
| Com. Ex. 3 | Obtained | 41000 | 17600 | 0.86 | −0.77 | C | B | B |
| Com. Ex. 4 | Obtained | 40000 | 80400 | 0.86 | −0.79 | B | C | B |
| Com. Ex. 5 | Obtained | 39000 | 40000 | 0.73 | −0.76 | C | B | C |
| Com. Ex. 6 | Obtained | 34000 | 41000 | 1.00 | −0.74 | B | D | A |
| Com. Ex. 7 | Obtained | 40000 | 39000 | 0.84 | −1.12 | B | C | C |
| Com. Ex. 8 | Obtained | 42000 | 40000 | 0.84 | −0.49 | C | B | B |

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrostatic charge image developing toner, comprising:

a toner particle contains a binder resin and a release agent and has a sea-island structure including a sea portion containing the binder resin and an island portion containing the release agent, and a melt viscosity of the toner satisfies the following Expression (1), a flow activation energy based on the Andrade equation of the toner satisfies the following Expression (2), a maximum frequent value in distribution of the following eccentricity B of the island portion containing the release agent shown in the following Expression (3) is in a range of 0.75 to 0.98, and a skewness in the distribution of the eccentricity B is in a range of −1.10 to −0.50:

$$4{,}000\text{Pa}\cdot\text{s} \leq \eta(100) \leq 200{,}000\text{Pa}\cdot\text{s} \qquad \text{Expression (1)}$$

wherein η(100) represents a melt viscosity (measured by an elevated flow tester) at 100° C.;

$$18{,}000J\cdot\text{mol}^{-1} \leq E \leq 80{,}000J\cdot\text{mol}^{-1} \qquad \text{Expression (2)}$$

wherein E represents a flow activation energy based on the Andrade equation; and $$\text{eccentricity } B = 2d/D \qquad \text{Expression (3)}$$

wherein D indicates an equivalent circle diameter (μm) of the toner in an observation of a cross-section of the toner, and d indicates a distance (μm) from a centroid of the toner to a centroid of the island portion containing the release agent in the observation of a cross-section of the toner, wherein the binder resin comprises:

a homopolymer comprising monomers of styrenes, (meth)acrylic esters, ethylenic unsaturated nitriles, vinyl ketones, or olefins;

a vinyl resin formed of a copolymer obtained by combining two or more monomers of styrenes, (meth)acrylic esters, ethylenic unsaturated nitrites, vinyl ketones, or olefins;

a non-vinyl resin comprising an epoxy resin, a polyester resin, a polyurethane resin, a polyamide resin, a cellulose resin, a polyether resin, or a modified rosin;

a mixture of the non-vinyl resin comprising an epoxy resin, a polyester resin, a polyurethane resin, a polyamide resin, a cellulose resin, a polyether resin, or a modified rosin and the vinyl resin; and/or a graft polymer obtained by polymerizing a vinyl monomer in the presence of the non-vinyl resin: and wherein the release agent comprises:

hydrocarbon waxes;

natural waxes;

synthetic waxes, mineral waxes, petroleum waxes; and/or ester waxes.

2. The electrostatic charge image developing toner according to claim 1, wherein a melting temperature of the release agent is from 50° C. to 110° C.

3. The electrostatic charge image developing toner according to claim 1, wherein a glass transition temperature of the binder resin is from 50° C. to 80° C.

4. The electrostatic charge image developing toner according to claim 1, wherein a maximum frequent value in distribution of eccentricity B is from 0.80 to 0.95.

5. The electrostatic charge image developing toner according to claim 1, wherein a skewness in distribution of the eccentricity B is from −1.00 to −0.60.

6. The electrostatic charge image developing toner according to claim 1, wherein a kurtosis in distribution of the eccentricity B is from −0.15 to +1.40.

7. The electrostatic charge image developing toner according to claim 1, wherein the melt viscosity η(100) is from 8,000 Pa·s to 160,000 Pa·s.

8. An electrostatic charge image developer comprising a carrier and the electrostatic charge image developing toner according to claim 1.

9. A toner cartridge which is detachable from an image forming apparatus comprising:

a storing portion stores the electrostatic charge image developing toner according to claim 1.

* * * * *